US011700946B2

(12) United States Patent
Pao

(10) Patent No.: US 11,700,946 B2
(45) Date of Patent: Jul. 18, 2023

(54) FOLDABLE SUPPORTING DEVICE

(71) Applicant: STEP2GOLD CO., LTD., Taichung (TW)

(72) Inventor: Chih-Ting Pao, Taichung (TW)

(73) Assignee: Step2Gold Co., Ltd., Taichung (TW)

( * ) Notice: Subject to any disclaimer, the term of this patent is extended or adjusted under 35 U.S.C. 154(b) by 0 days.

(21) Appl. No.: 17/586,146

(22) Filed: Jan. 27, 2022

(65) Prior Publication Data

US 2022/0240682 A1 Aug. 4, 2022

(30) Foreign Application Priority Data

Feb. 1, 2021 (TW) ..... 110103709

(51) Int. Cl.
*A47C 12/00* (2006.01)
*A45B 5/00* (2006.01)
*A47C 4/02* (2006.01)

(52) U.S. Cl.
CPC ..... *A47C 12/00* (2013.01); *A45B 5/00* (2013.01); *A47C 4/02* (2013.01)

(58) Field of Classification Search
CPC .. A45B 5/00; B47C 9/105; A47C 9/10; A47C 13/00; A47C 12/00; A47C 12/02; A47C 4/02
See application file for complete search history.

(56) References Cited

U.S. PATENT DOCUMENTS

| | | | | |
|---|---|---|---|---|
| 9,504,297 | B2 * | 11/2016 | Pao | A47C 4/04 |
| D894,585 | S * | 9/2020 | Ye | A45B 3/00 |
| 11,006,708 | B1 * | 5/2021 | Hoyes | A45B 5/00 |
| 2014/0034097 | A1 * | 2/2014 | Pao | A45B 5/00 135/66 |

FOREIGN PATENT DOCUMENTS

| | | | | |
|---|---|---|---|---|
| EP | 2893830 | A1 * | 7/2015 | A45B 5/00 |
| TW | M467398 | | 12/2013 | |

* cited by examiner

*Primary Examiner* — Milton Nelson, Jr.
(74) *Attorney, Agent, or Firm* — Burris Law, PLLC

(57) ABSTRACT

A foldable supporting device includes a linkage unit, a supporting unit and a converting unit. The supporting unit includes a main supporting member that has a first main supporting surface, and at least one auxiliary supporting member that has a first auxiliary supporting surface. The converting unit has at least one converting part that is drivable by movement of the linkage unit to convert the supporting unit between a folded state in which the first main supporting surface and the first auxiliary supporting surface cooperatively form a first angle, and an unfolded state in which the first main supporting surface and the first auxiliary supporting surface cooperatively form a second angle.

14 Claims, 25 Drawing Sheets

FOLDABLE SUPPORTING DEVICE

CROSS-REFERENCE TO RELATED APPLICATION

This application claims priority to Taiwanese Invention Patent Application No. 110103709, filed on Feb. 1, 2021.

FIELD

The disclosure relates to a foldable device, and more particularly to a foldable supporting device.

BACKGROUND

Generally, people who are physically challenged, or people whose bodily functions have declined (e.g. the elderly) do not have enough strength to walk for a long time. When they need to walk for a long distance, they may have to take a break from time to time to regain their strength so that they can keep on walking. Therefore, some manufacturers have produced multifunctional devices (e.g. a conventional foldable supporting device) that are adaptable to user requirements, to serve both as an aid to walking and as a seat for users to rest.

The conventional foldable supporting device is disclosed in Taiwanese Utility Model Patent No. M467398 as a cane chair, and includes a base seat, a plurality of support legs and a seating cloth body. The base seat is in a shape of a quadrangular prism and is formed with a plurality of pivot grooves. Each of the pivot grooves extends through the base seat and is oblique to the base seat so that a top end and a bottom end of each of the pivot grooves are not aligned with each other along a normal vector of the base seat. Each of the support legs extends through a respective one of the pivot grooves and is rotatably connected to the base seat. One of the support legs includes a support block that cooperates with a top end of each of the rest of the support legs to be connected to the seating cloth body (i.e., the seating cloth body is fixedly laid over the support block of the one of the support legs and the top ends of the rest of the support legs).

The conventional foldable supporting device is convertible between a folded state in which the support legs are parallel to each other, and an unfolded state in which the support legs are oblique to each other. In order to make the conventional foldable supporting device serve as a seat, each of the support legs is rotated relative to the base seat with a junction between the support leg and the respective one of the pivot grooves serving as a pivot such that the support block of the one of the support legs and the top ends of the rest of the support legs recede from each other until the support leg abuts against the base seat. At this time, rotation of each of the support legs is restrained by the base seat so that each of the support legs can stand on the ground while being oblique to the ground and to each other (i.e., the conventional foldable supporting device is in the unfolded state). Subsequently, the support block of the one of the support legs and the top ends of the rest of the support legs cooperatively unfold the seating cloth body so that the seating cloth body and the support legs are able to cooperatively serve as a seat to support a user.

The conventional foldable supporting device may be used as a cane when folded, and serves as a seat when converted into the unfolded state. However, during the conversion of the conventional foldable supporting device from the folded state to the unfolded state, or from the unfolded state to the folded state, the support legs need to be individually operated. Although the conventional foldable supporting device may be folded or unfolded as required by a user, the individual operation of the support legs during the conversion could be slow and frustrating for the user. Especially for elderly users who may have to rely on the cane function of the conventional foldable supporting device for support, such users would find the conversion of the conventional foldable supporting device laborious.

SUMMARY

Therefore, an object of the disclosure is to provide a foldable supporting device that can alleviate the drawback of the prior art.

According to the disclosure, the foldable supporting device is adapted to be connected to a positioning member, and includes a supporting unit, a linkage unit and a converting unit. The supporting unit includes a main supporting member and at least one auxiliary supporting member. The main supporting member is adapted to be connected to the positioning member and has a first main supporting surface. The at least one auxiliary supporting member is pivotally connected to the main supporting member, and has an inner edge, an outer edge, a first auxiliary supporting surface, a second auxiliary supporting surface and a push block. The inner edge is adjacent to the main supporting member. The outer edge is opposite to the inner edge. The first auxiliary supporting surface extends from the inner edge to the outer edge. The second auxiliary supporting surface is opposite to the first auxiliary supporting surface. The push block has a push surface that extends from the second auxiliary supporting surface, and that has an inner surface end and an outer surface end. The inner surface end and the outer surface end are respectively proximate to and distal from the inner edge. One of the main supporting member and the at least one auxiliary supporting member has a guiding section that corresponds in position to the push block. The linkage unit is connected to the main supporting member of the supporting unit. The converting unit corresponds in position to the push block, has at least one converting part, and is movably connected to the guiding section of the one of the main supporting member and the at least one auxiliary supporting member such that movement of the linkage unit drives the converting unit to move along the guiding section, and drives the converting part to push the push surface of the push block, so as to convert the supporting unit between a folded state in which the first main supporting surface of the main supporting member and the first auxiliary supporting surface of the at least one auxiliary supporting member cooperatively form a first angle, and an unfolded state in which the first main supporting surface of the main supporting member and the first auxiliary supporting surface of the at least one auxiliary supporting member cooperatively form a second angle that is different from the first angle.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
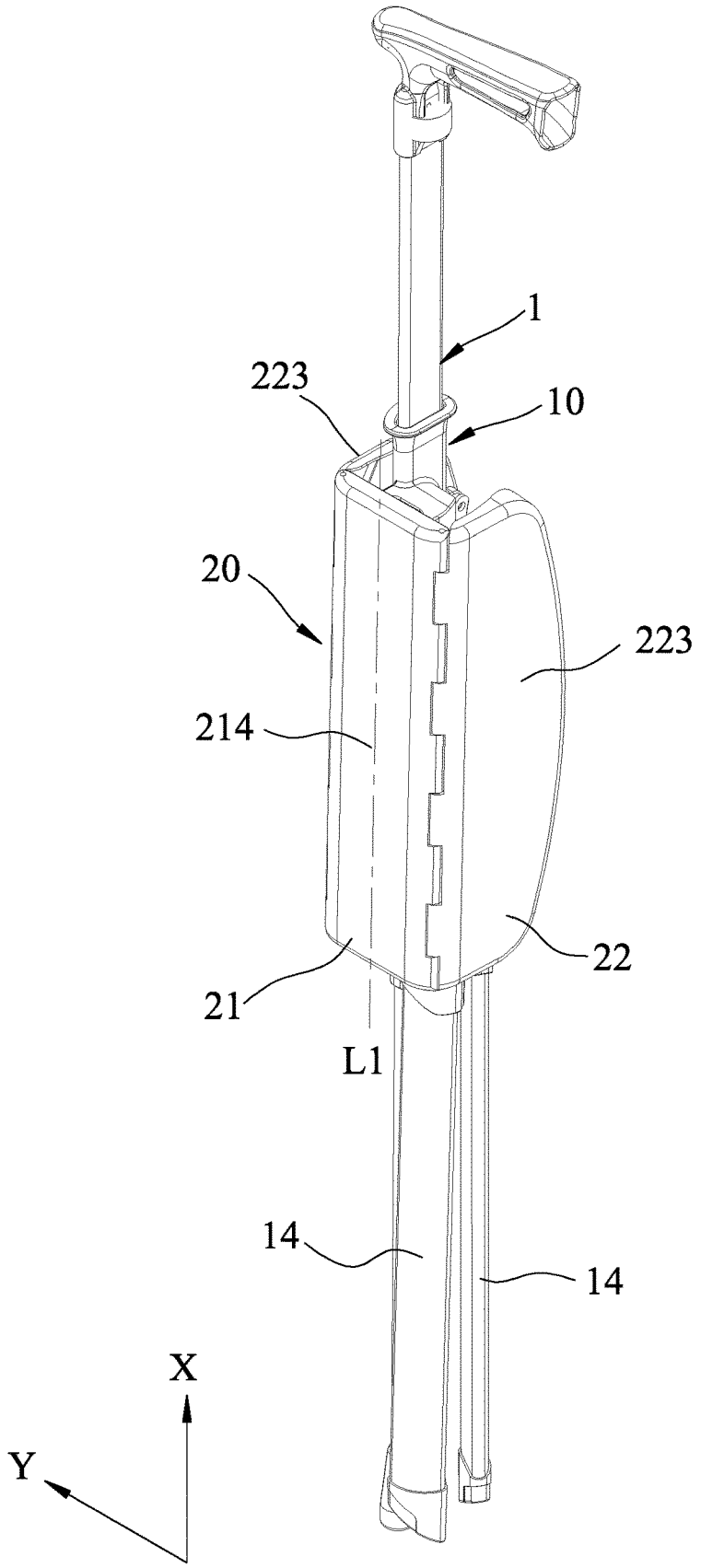
FIG. 1 is a perspective view illustrating a first embodiment of a foldable supporting device according to the disclosure in a folded state.
Figure 2:
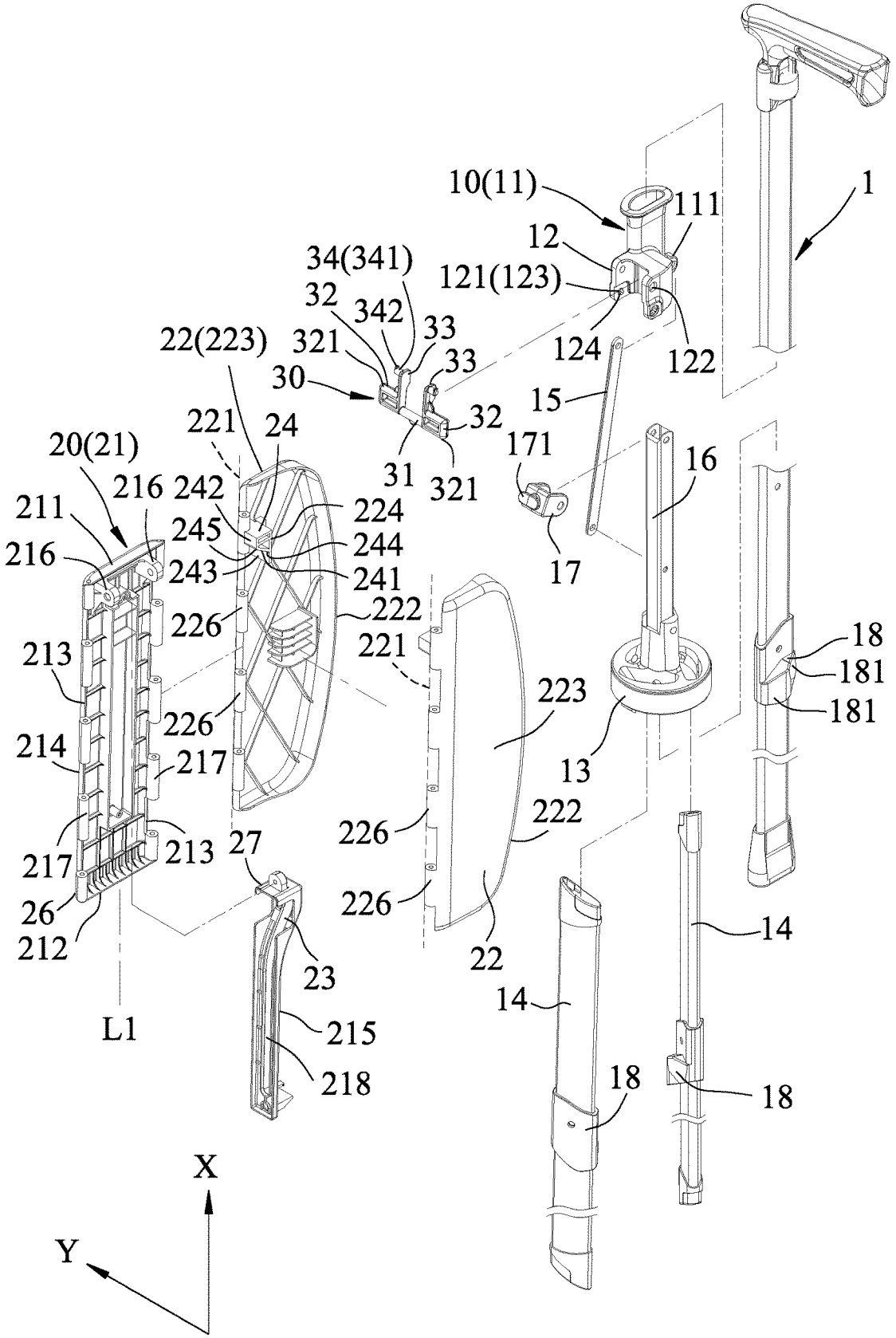
FIG. 2 is a fragmentary, exploded perspective view of the first embodiment.
Figure 3:
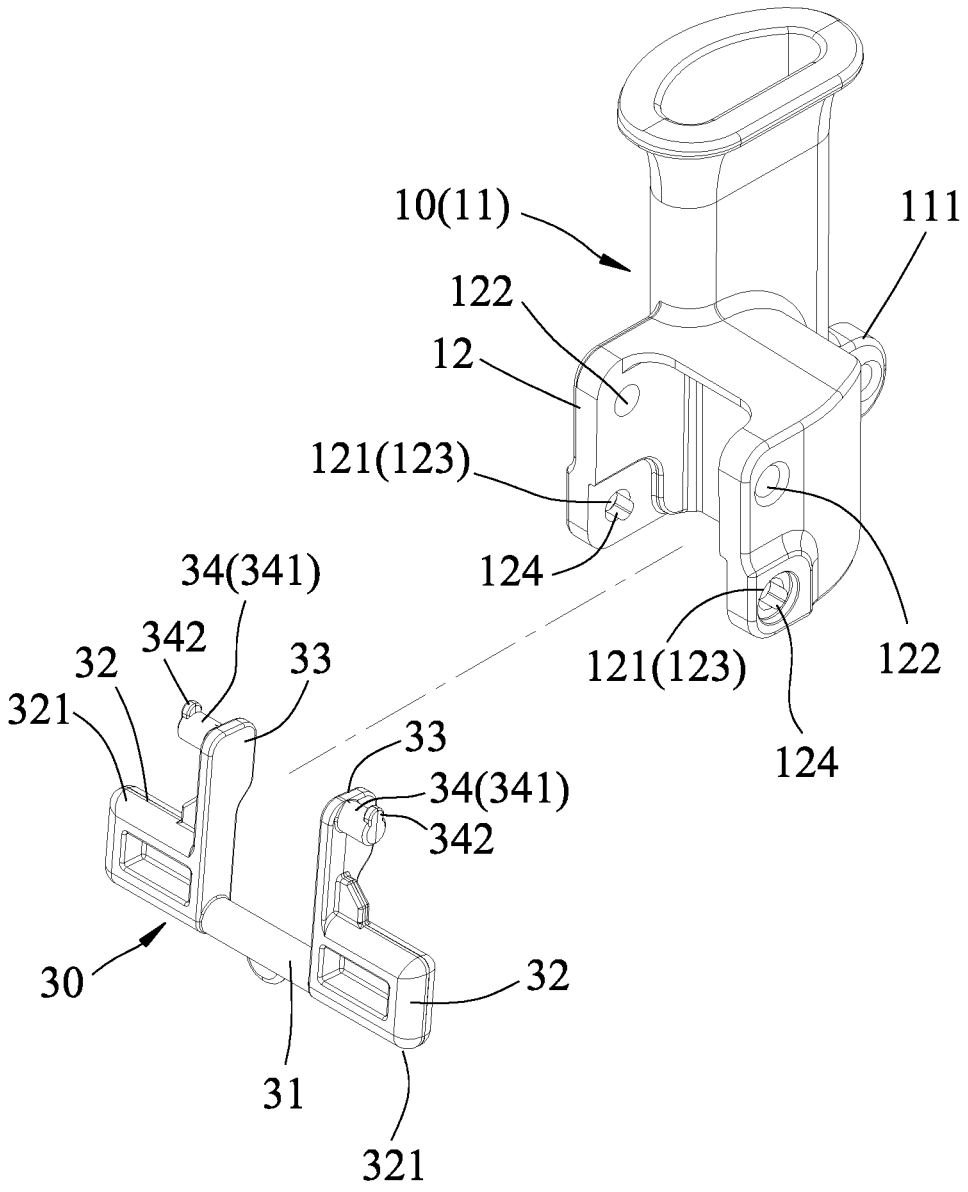
FIG. 3 is an exploded perspective view illustrating a linking member of a linkage unit and a converting unit of the first embodiment.
Figure 4:
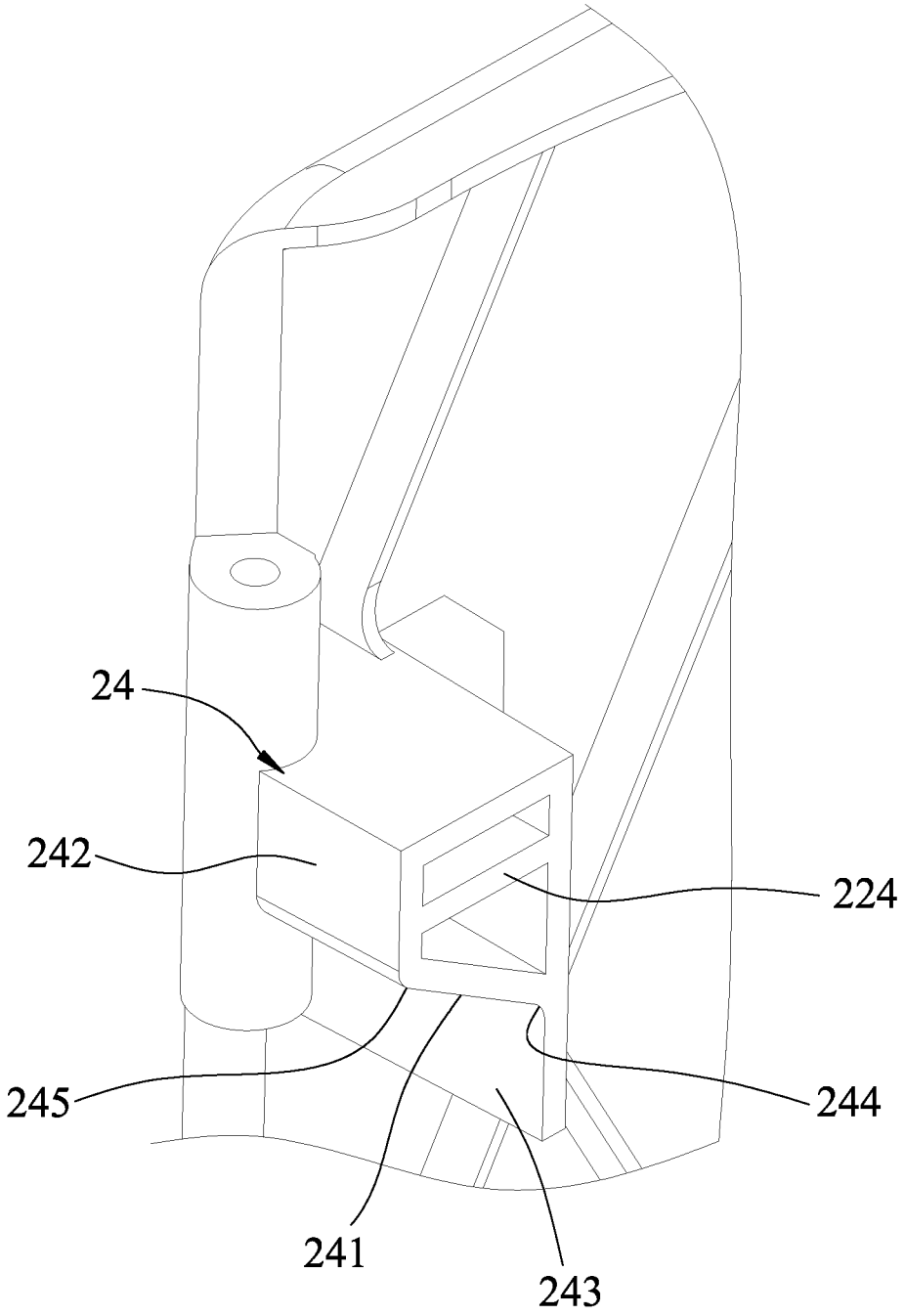
FIG. 4 is a fragmentary perspective view of an auxiliary supporting member of a supporting unit of the first embodiment.
Figure 5:
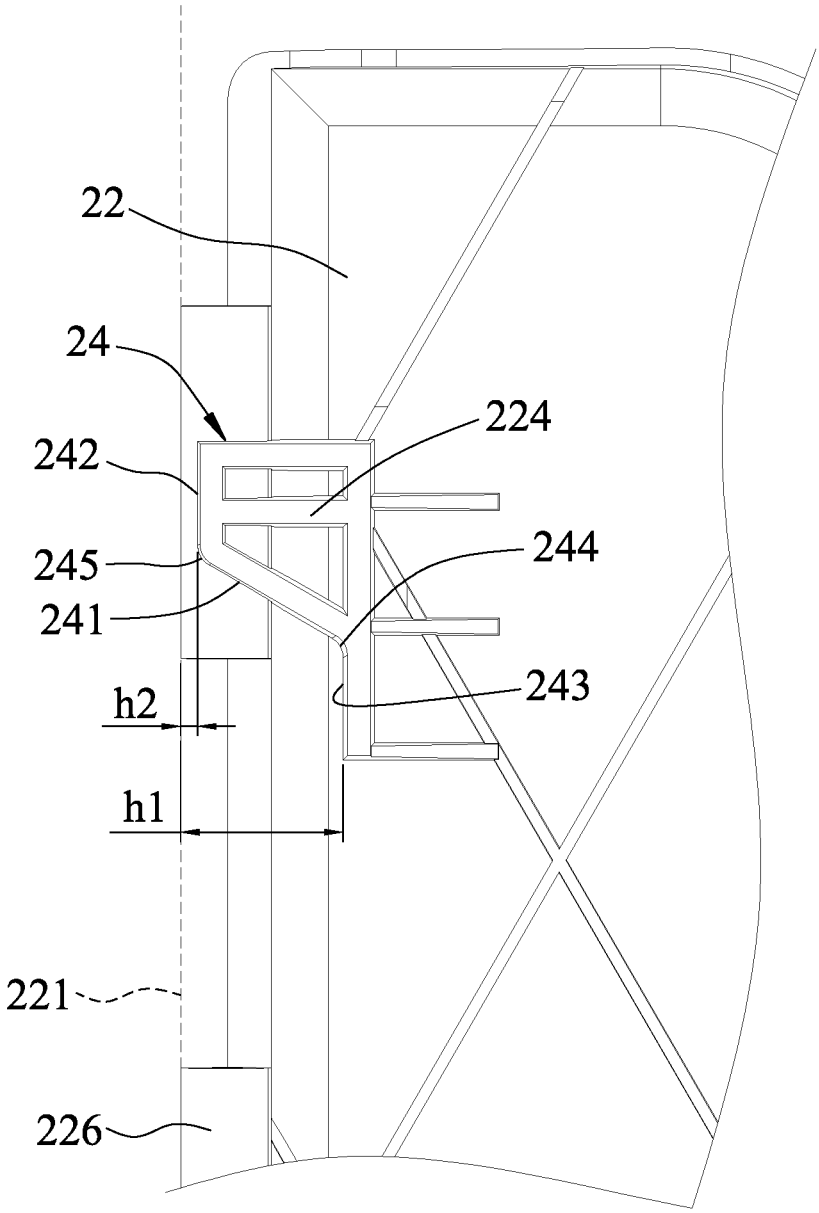
FIG. 5 is a fragmentary side view of the auxiliary supporting member.
Figure 6:
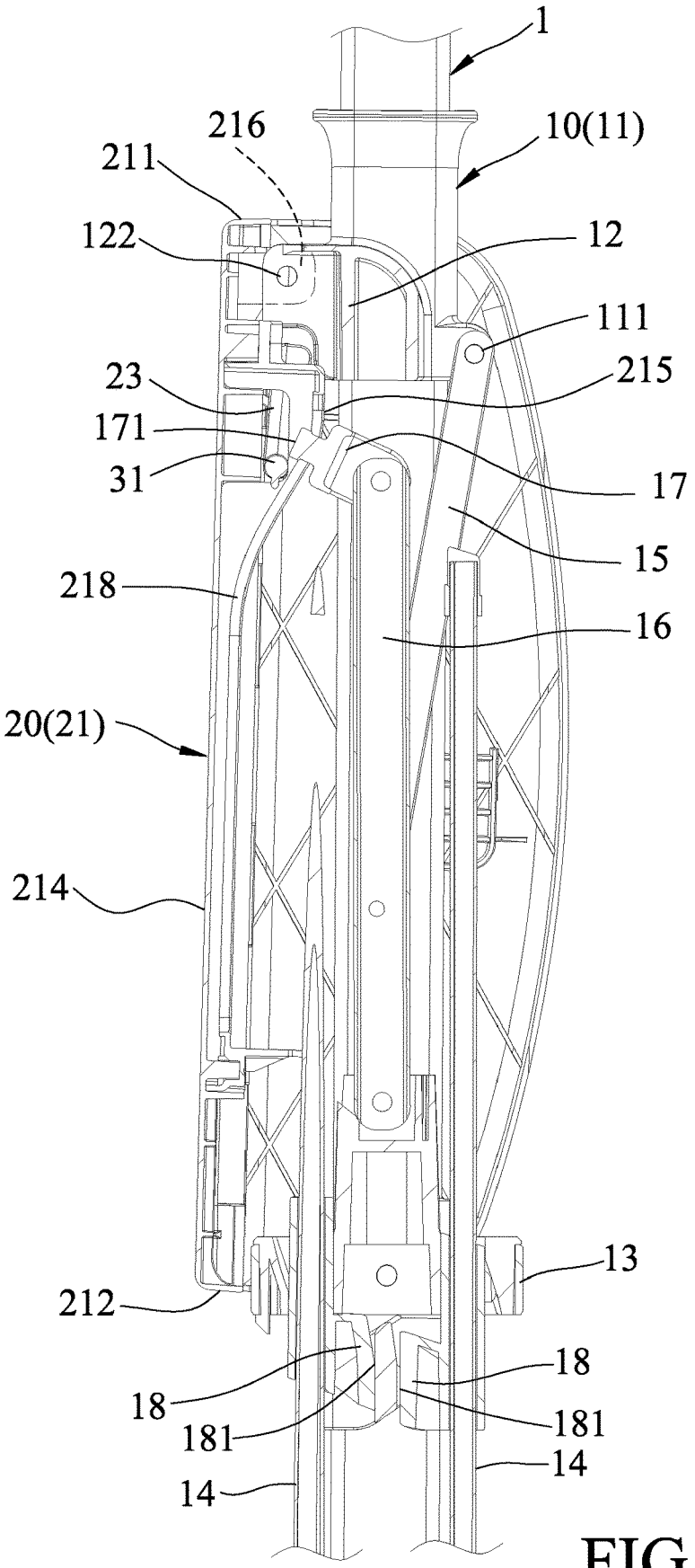
FIG. 6 is a fragmentary, enlarged sectional view of the first embodiment.
Figure 7:
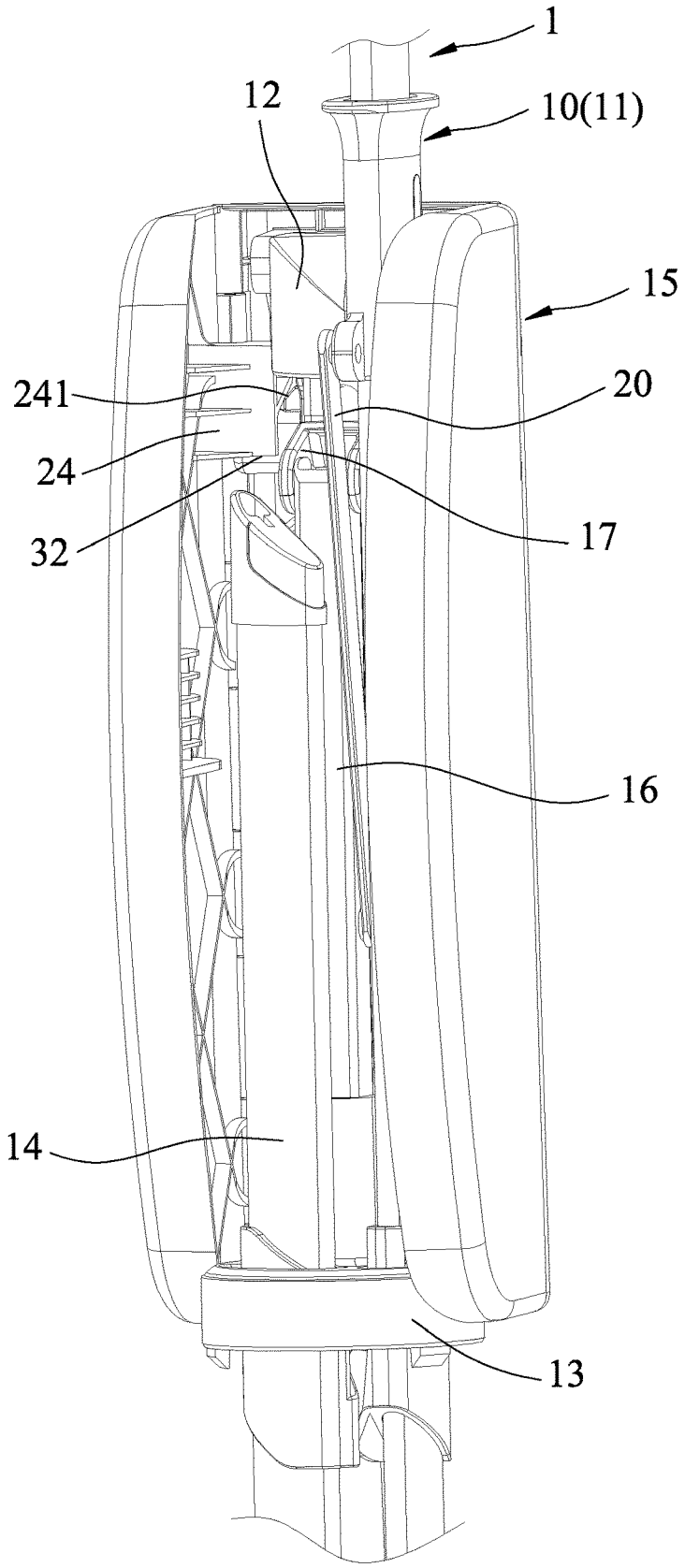
FIG. 7 is a fragmentary, enlarged perspective view of the first embodiment.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 7, a first embodiment of a foldable supporting device according to the disclosure is adapted to be connected to a positioning member 1. The foldable supporting device may be configured to be, but not limited to, a folding cane seat. In the first embodiment, a folding cane seat is used as an example for description purposes. The foldable supporting device includes a linkage unit 10, a supporting unit 20 and a converting unit 30.

The linkage unit 10 includes a slide tube 11, a linking member 12, a pivot seat 13, two support rods 14, a first linking rod 15, a second linking rod 16 and a rail connecting member 17. The slide tube 11 is adapted to be slidably sleeved on the positioning member 1. The linking member 12 is connected to the slide tube 11. The pivot seat 13 is adapted to be pivotally connected to the positioning member 1 and is spaced apart from the slide tube 11. The support rods 14 are pivotally connected to the pivot seat 13. The first linking rod 15 is pivotally connected to the slide tube 11. The second linking rod 16 is pivotally connected to the pivot seat 13 and the first linking rod 15. The rail connecting member 17 is pivotally connected to the second linking rod 16. Specifically, the pivot seat 13 and the rail connecting member 17 are respectively and pivotally connected to two opposite ends of the second linking rod 16. The slide tube 11 is configured to be in a shape of a hollow tube, and has a pivot ear 111. The linking member 12 is formed with a pair of pivot holes 121 and a pair of mounting holes 122 that are located at one side of the pivot holes 121. Each of the pivot holes 121 has a main circular hole portion 123 and an auxiliary hole portion 124 that extends radially outwardly from the main hole portion 123 (see FIG. 3). The rail connecting member 17 has an engaging head 171 that is configured to be T-shaped. Each of the support rods 14 and the positioning member 1 includes a push protrusion 18 that has two push surfaces 181 (see FIG. 2) connected in the form of a V shape.

The supporting unit 20 includes a main supporting member 21 and two auxiliary supporting members 22. The main supporting member 21 is adapted to be connected to the positioning member 1. Specifically, the main supporting member 21 is adapted to be connected to the positioning member 1 via the linkage unit 10 (i.e., the linkage unit 10 interconnects the main supporting member 21 and the positioning member 1). However, in certain embodiments, the main supporting member 21 may be adapted to be directly connected to the positioning member 1. The auxiliary supporting members 22 are pivotally and respectively connected to two opposite sides of the main supporting member 21. The main supporting member 21 has an imaginary axis (L1) that is located between the opposite sides of the main supporting member 21. The main supporting member 21 is pivotable relative to the positioning member 1. The imaginary axis (L1) and the positioning member 1 cooperatively form an angle that changes as the main supporting member 21 pivots. In the first embodiment, the main supporting member 21 has a guiding section 23.

The main supporting member 21 has a guiding rail groove 218, a first main supporting surface 214 and a second main supporting surface 215 opposite to the first main supporting surface 214. The main supporting member 21 further has a first end 211, a second end 212, two spaced-apart connecting edges 213, two pivot protrusions 216 and a plurality of main barrels 217. The first end 211 and the second end 212 are located at two opposite sides of the first main supporting surface 214 along the imaginary axis (L1). Each of the connecting edges 213 interconnects the first end 211 and the second end 212. The linkage unit 10 is pivotally connected to the first end 211 of the supporting member body 26. In this embodiment, the linking member 12 of the linkage unit 10 is pivotally connected to the main supporting member 21 and is adjacent to the first end 211 of the main supporting member 21. Specifically, the pivot protrusions 216 are disposed at the first end 211, and are respectively and pivotally connected to the mounting holes 122 of the linking member 12. The main barrels 217 are disposed on the connecting edges 213 (i.e., some of the main barrels 217 are disposed on one of the connecting edges 213 and the rest of the main barrels 217 are disposed on the other one of the connecting edges 213). In this embodiment, the main supporting member 21 is composed of a supporting member body 26 and a rail base 27. The supporting member body 26 has the first main supporting surface 214. The rail base 27 is located at one side of the supporting member body 26 opposite to the first main supporting surface 214, and is connected to the supporting member body 26 by screws. In this embodiment, the rail base 27 has the second main supporting surface 215 and the guiding rail groove 218. The guiding rail groove 218 of the rail base 27 is indented from the second main supporting surface 215 toward the first main supporting surface 214 of the supporting member body 26. The guiding rail groove 218 extends in the extending direction of the imaginary axis (L1), and has a width that increases away from the second main supporting surface 215. Specifically, the cross section of the guiding rail groove 218 that is perpendicular to the imaginary axis (L1) is configured to be T-shaped and corresponds to the shape of the engaging head 171 of the rail connecting member 17. The engaging head 171 of the rail connecting member 17 is movably connected to the guiding rail groove 218 and is movable along the guiding rail groove 218.

The guiding section 23 of the main supporting member 21 is disposed between the connecting edges 213 and is configured to be a groove that is elongated in the extending direction of the imaginary axis (L1). In the first embodiment, the guiding section 23 is formed at the rail base 27 (see FIG. 2). Specifically, the guiding section 23 of the main supporting member 21 is located between the first main supporting surface 214 of the supporting member body 26 and the second main supporting surface 215 of the rail base 27, is parallel to the first main supporting surface 214, and is adjacent to the first end 211 of the supporting member body 26.

The auxiliary supporting members 22 are respectively and pivotally connected to the connecting edges 213 of the main supporting member 21. Each of the auxiliary supporting members 22 has an inner edge 221, an outer edge 222, a first auxiliary supporting surface 223, a second auxiliary supporting surface 224, a push block 24 and a plurality of auxiliary barrels 226. The inner edge 221 is adjacent to the main supporting member 21. Specifically, the inner edge 221 of each of the auxiliary supporting members 22 corresponds in position to a respective one of the connecting edges 213 of said main supporting member 21. The outer edge 222 is opposite to the inner edge 221. The first auxiliary supporting surface 223 extends from the inner edge 221 to the outer edge 222. The second auxiliary supporting surface 224 is opposite to the first auxiliary supporting surface 223. Specifically, the second auxiliary supporting surface 224 is disposed on the push block 24. The push block 24 corresponds in position to the guiding section 23 of the main supporting member 21 (i.e., the push block 24 is adjacent to the first end 211 of the main supporting member 21). The auxiliary barrels 226 of each of the auxiliary supporting members 22 are disposed on the inner edge 221 of the auxiliary supporting member 22 and are rotatably connected to the main barrels 217 of the respective one of the connecting edges 213 of the main supporting member 21 so that each of the auxiliary supporting members 22 is pivotally connected to the main supporting member 21. The push block 24 has a push surface 241, an abutting surface 242 and a guiding surface 243 (see FIGS. 4 and 5). For each of the auxiliary supporting members 22, the push surface 241 extends from the second auxiliary supporting surface 224, and has an inner surface end 245 and an outer surface end 244 that are respectively proximate to and distal from the inner edge 221. The push surface 241 extends toward the first end 211 of the main supporting member 21 when extending from the outer surface end 244 to the inner surface end 245. Specifically, the outer surface end 244 and the inner surface end 245 are not on a plane that is perpendicular to the imaginary axis (L1) (i.e., the push surface 241 is oblique to the plane that is perpendicular to the imaginary axis (L1)). In the first embodiment, the push surface 241 is smooth, and the abutting surface 242 and the guiding surface 243 are respectively connected to the inner surface end 245 and the outer surface end 244 of the push surface 241, and are parallel to the extending direction of the imaginary axis (L1) (see FIG. 2). The inner edge 221 of each of the auxiliary supporting members 22 cooperates with the outer surface end 244 of the push block 24 of the auxiliary supporting member 22 to define a first distance (h1) therebetween, and cooperates with the inner surface end 245 of the push block 24 to define a second distance (h2) therebetween that is smaller than the first distance (h1) (see FIG. 5).

The converting unit 30 extends in a direction perpendicular to the extending direction of the imaginary axis (L1), is movably connected to the guiding section 23 of the main supporting member 21, and includes a bar member 31, a pair of converting plates 32, a pair of pivoting plates 33, and a pair of hole-connecting parts 34. The bar member 31 is configured to be rod-shaped, extends through the guiding section 23 of the main supporting member 21, has two opposite ends in the direction perpendicular to the extending direction of the imaginary axis (L1), and is rotatable and movable relative to the guiding section 23. The converting plates 32 are respectively connected to the opposite ends of the bar member 31 and respectively correspond in position to the push blocks 24 of the supporting unit 20. Each of the converting plates 32 has a converting part 321 that is located at the periphery thereof (i.e., the bar member 31 is disposed on one side of the converting part 321 of each of the converting plates 32). The pivot plates 33 are respectively connected to the converting plates 32. The converting part 321 of each of the converting plates 32 and the respective one of the pivoting plates 33 are respectively disposed on two opposite ends of the converting unit 30. The hole-connecting parts 34 are respectively disposed on the pivot plates 33. Each of the pivot plates 33 is pivotally connected to the linkage unit 10 by the respective one of the hole-connecting parts 34. Specifically, each of the hole-connecting parts 34 is rotatably connected to a respective one of the pivot holes 121 of the linking member 12, and has a main circular rod portion 341 and an auxiliary protrusion 342 that extends radially outward from the main circular rod portion 341. For each of the hole-connecting parts 34, during assembly of the converting unit 30 and the linking member 12, the auxiliary protrusion 342 extends through the auxiliary hole portion 124 of the respective one of the pivot holes 121 while the main circular rod portion 341 extends through the main circular hole portion 123 of the respective one of the pivot holes 121. After assembly, the auxiliary protrusion 342 is located at one side of the respective one of the pivot holes 121 opposite to the other one of the pivot holes 121 and is separated from the auxiliary hole portion 124 of the respective one of the pivot holes 121.

Figure 11:
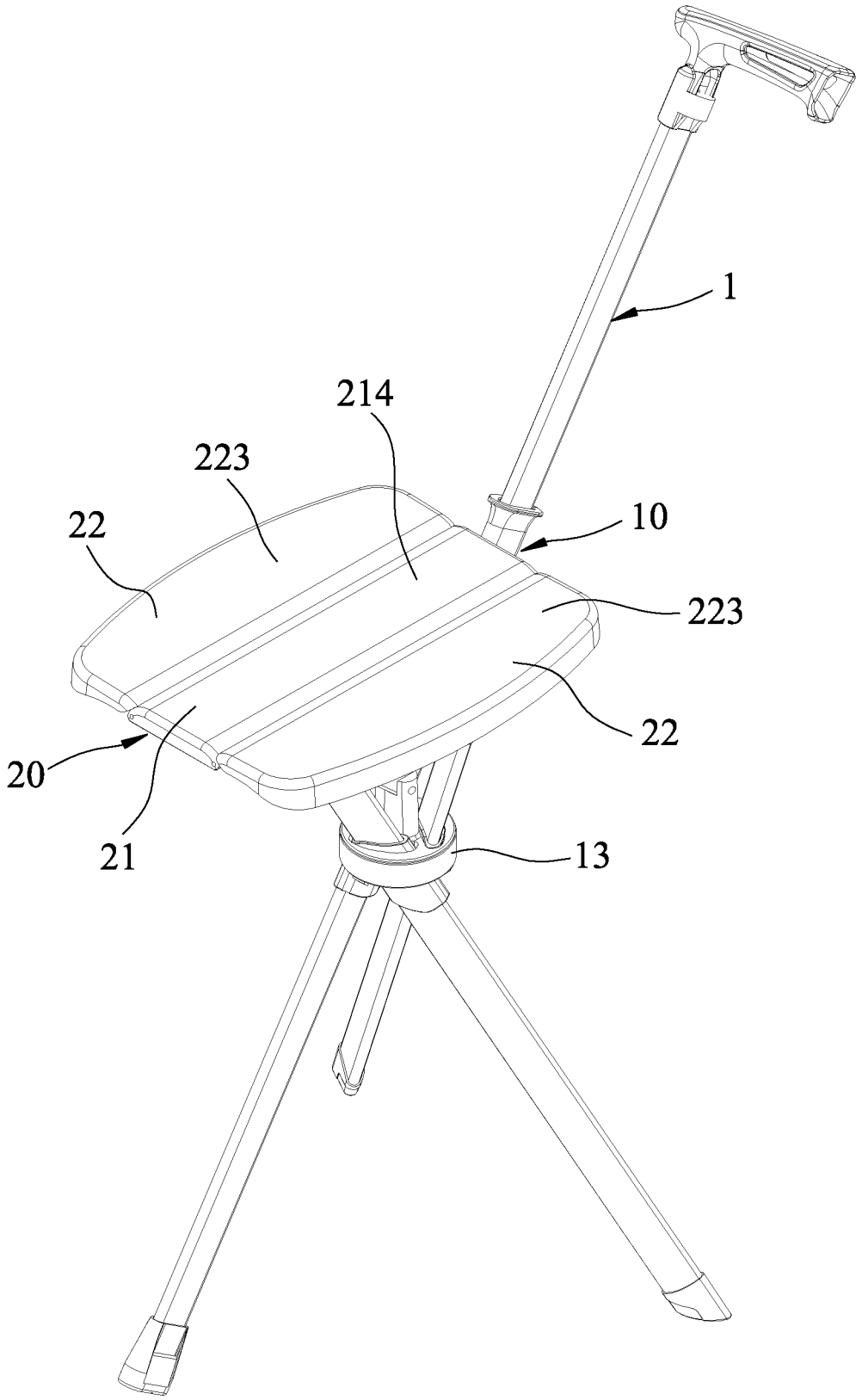
FIG. 11 is a perspective view illustrating the first embodiment in an unfolded state.

Movement of the linkage unit 10 drives the converting unit 30 to move along the guiding section 23 of the supporting unit 20, and drives the converting part 321 of each of the converting plates 32 to push the push surface 241 of the respective one of the push blocks 24 of the supporting unit 20, so as to convert the supporting unit 20 between a folded state (see FIG. 1) in which the first main supporting surface 214 of the main supporting member 21 and the first auxiliary supporting surface 223 of each one of the auxiliary supporting members 22 cooperatively form a first angle, and an unfolded state (see FIG. 11) in which the first main supporting surface 214 of the main supporting member 21 and the first auxiliary supporting surface 223 of each one of the auxiliary supporting members 22 cooperatively form a second angle that is different from the first angle. In one embodiment, the first main supporting surface 214 is flush with the first auxiliary supporting surface 223 of each one of the auxiliary supporting members 22 when the supporting unit 20 is in the unfolded state.

In the following description, the advantages provided by the first embodiment of the foldable supporting device of the disclosure are described.

Figure 15:
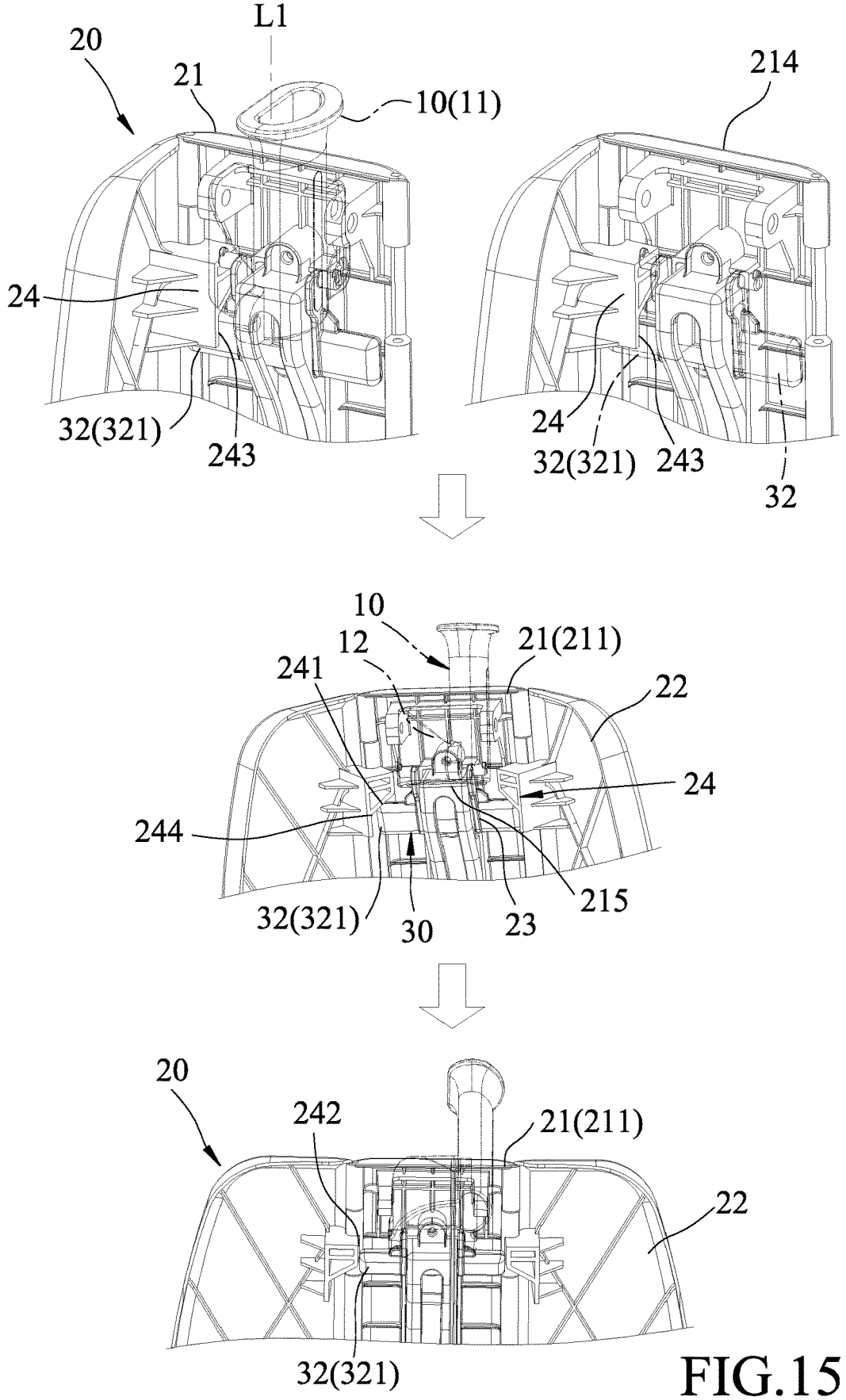
FIG. 15 illustrates the first embodiment being converted from the folded state to the unfolded state.
Figure 16:
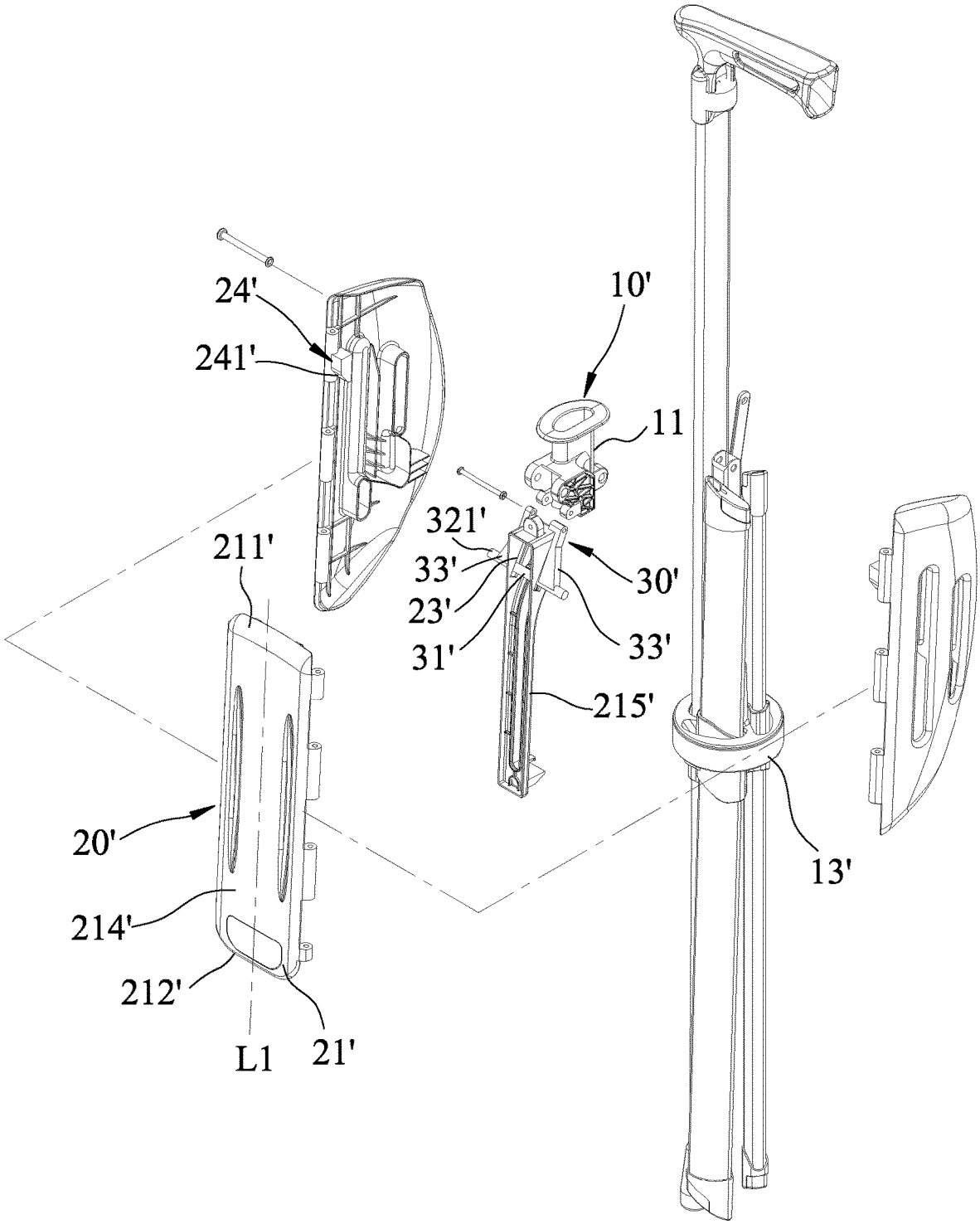
FIG. 16 is an exploded perspective view illustrating a second embodiment of the foldable supporting device.
Figure 17:
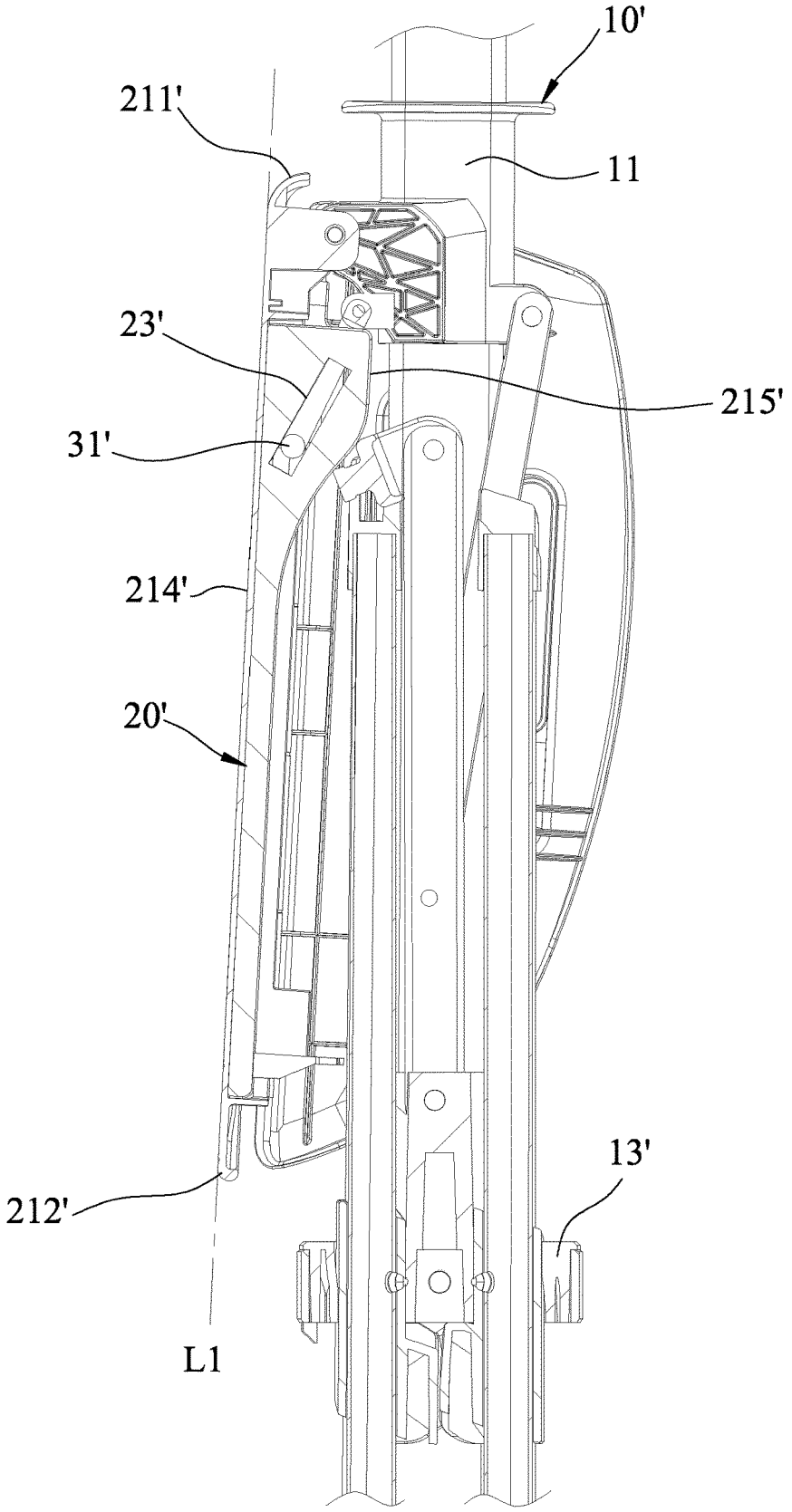
FIG. 17 is a fragmentary sectional view illustrating the second embodiment in a folded state.
Figure 18:
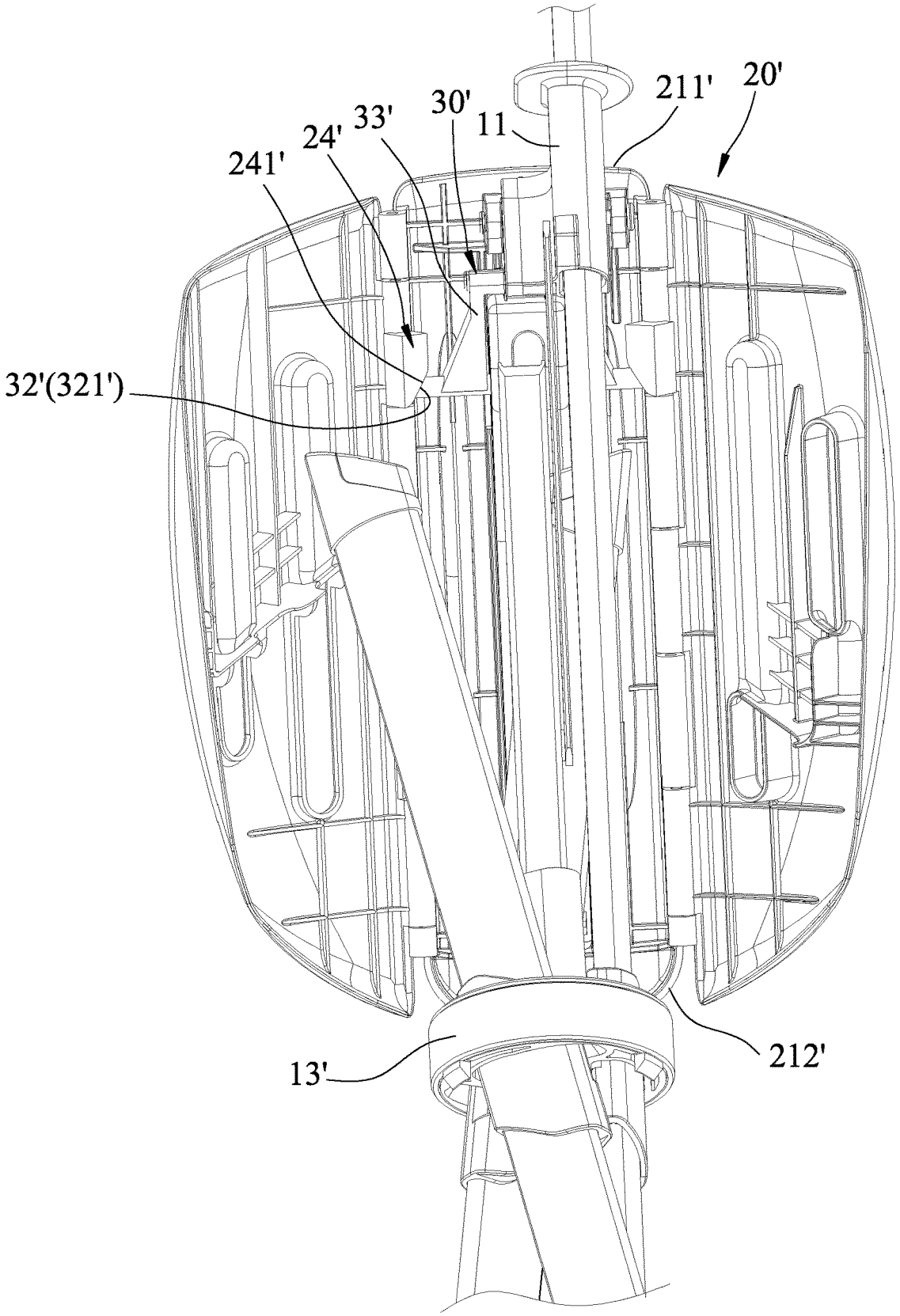
FIG. 18 is a fragmentary perspective view illustrating the second embodiment during conversion from the folded state to an unfolded state.
Figure 19:
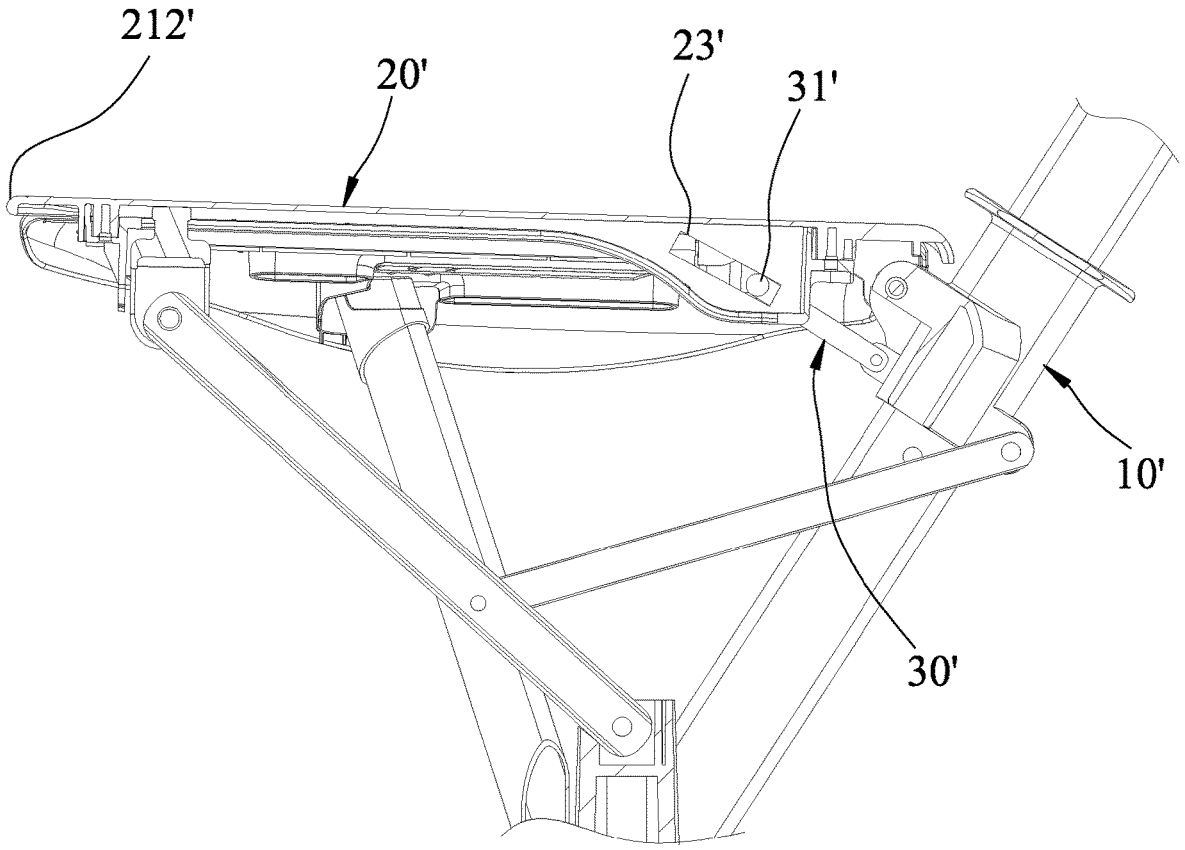
FIG. 19 is a fragmentary sectional view illustrating the second embodiment in the unfolded state.
Figure 20:
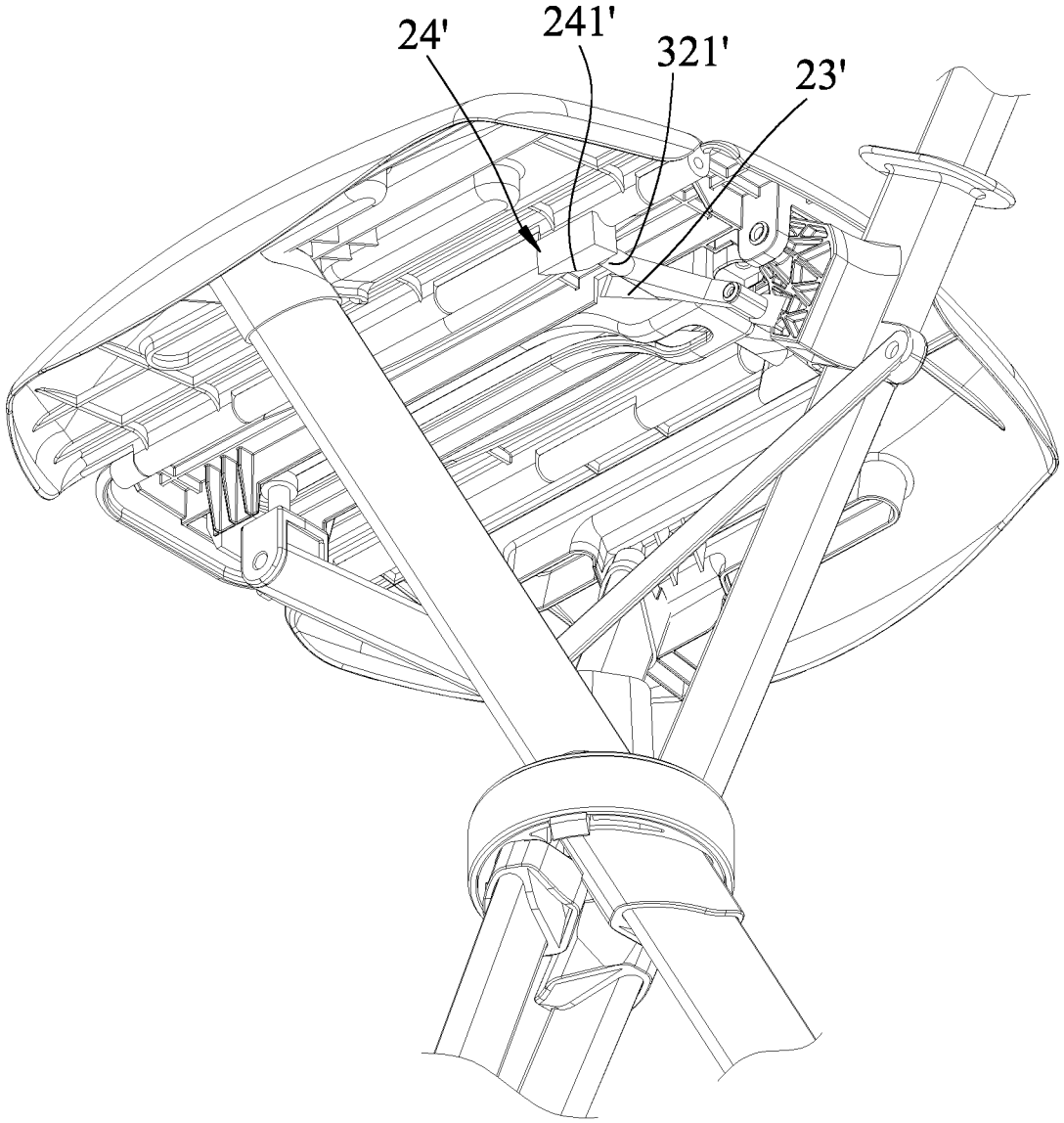
FIG. 20 is a fragmentary perspective view illustrating the second embodiment in the unfolded state.

Referring further to FIG. 15, in cooperation with FIGS. 1, 2, 6 and 7, when the supporting unit 20 is in the folded state, the support rods 14 of the linkage unit 10 and the positioning member 1 are adjacent to each other and are substantially parallel to each other. The push protrusions 18 of the support rods 14 and the push protrusion 18 of the positioning member 1 are adjacent to each other so that the push surfaces 181 of each of the push protrusions 18 respectively face one of the push surfaces 181 of one of the push protrusions 18 and one of the push surfaces 181 of the other one of the push protrusions 18. At this time, the extending direction of the imaginary axis (L1) is parallel to a first direction (X), and the direction in which the converting unit 30 extends is parallel to a second direction (Y) perpendicular to the first direction (X). The second end 212 of the main supporting member 21 of the supporting unit 20 is adjacent to the pivot seat 13 of the linkage unit 10. When the first main supporting surface 214 of the main supporting member 21 and the first auxiliary supporting surface 223 of each one of the auxiliary supporting members 22 are at the first angle, the main supporting member 21 and the auxiliary supporting members 22 cooperatively form a U shape that partially surrounds the pivot seat 13. The rail connecting member 17 of the linkage unit 10 is adjacent to the first end 211 of the main supporting member 21. Each of the converting plates 32 of the converting unit 30 is located between the respective one of the push blocks 24 of the supporting unit 20 and the first main supporting surface 214 of the main supporting member 21.

Figure 8:
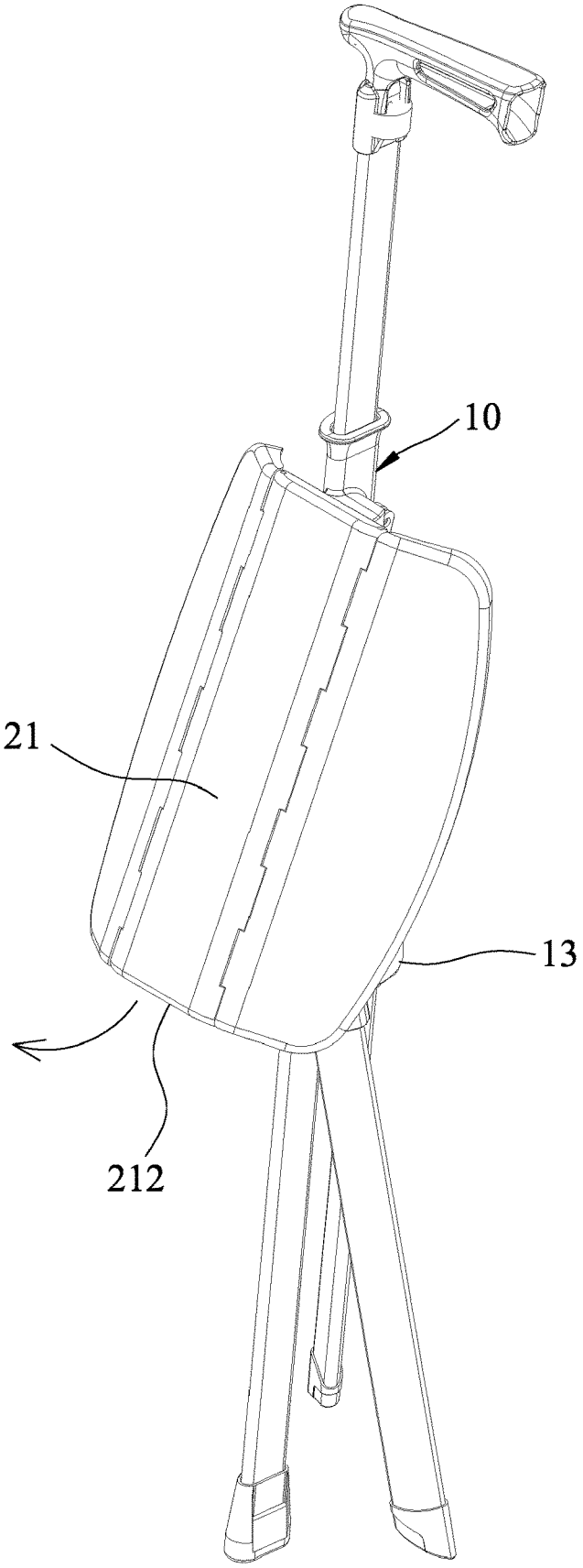
FIG. 8 is a perspective view illustrating the first embodiment in operation.
Figure 9:
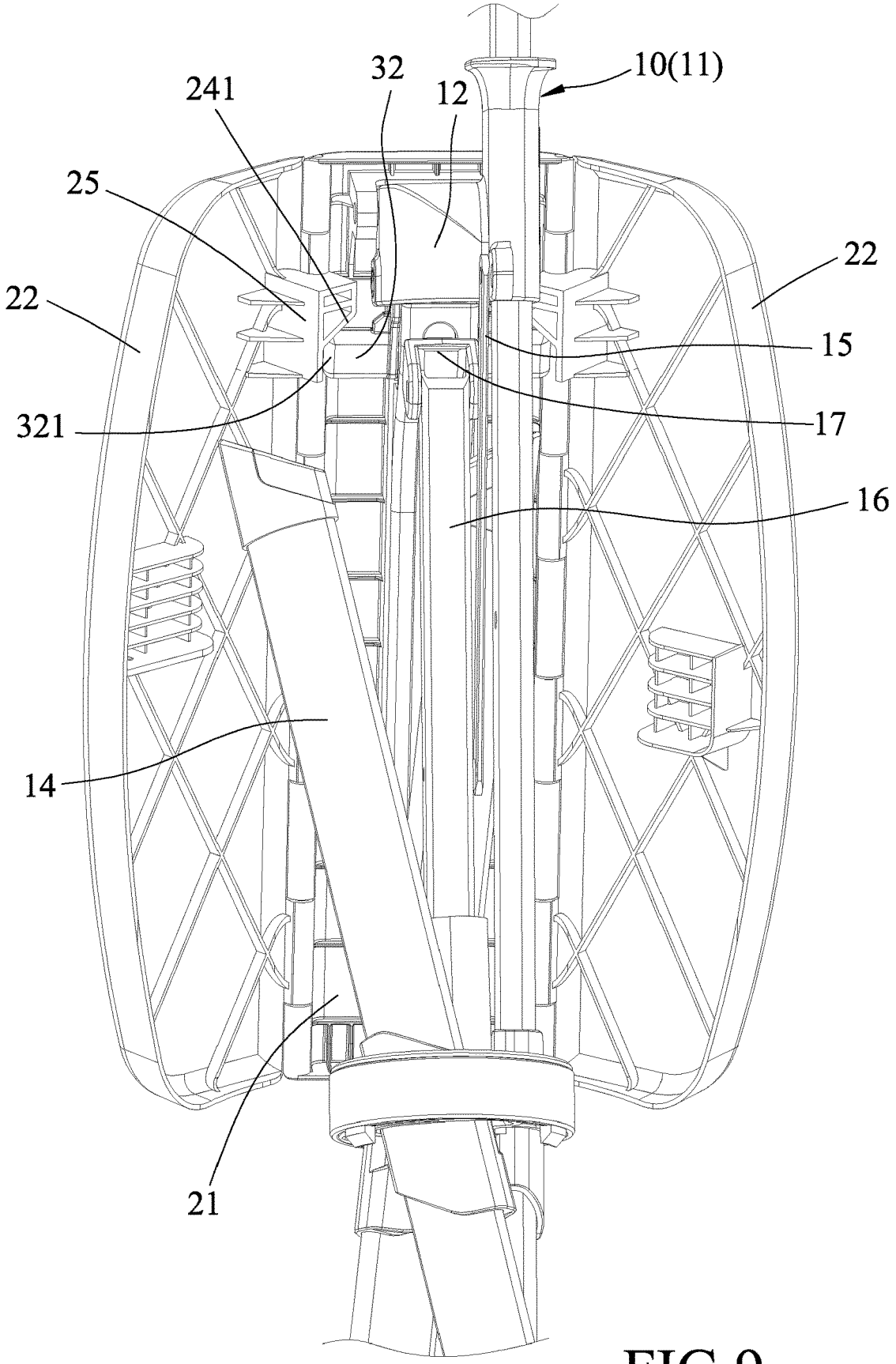
FIG. 9 is a fragmentary, enlarged perspective view of the first embodiment in operation.
Figure 10:
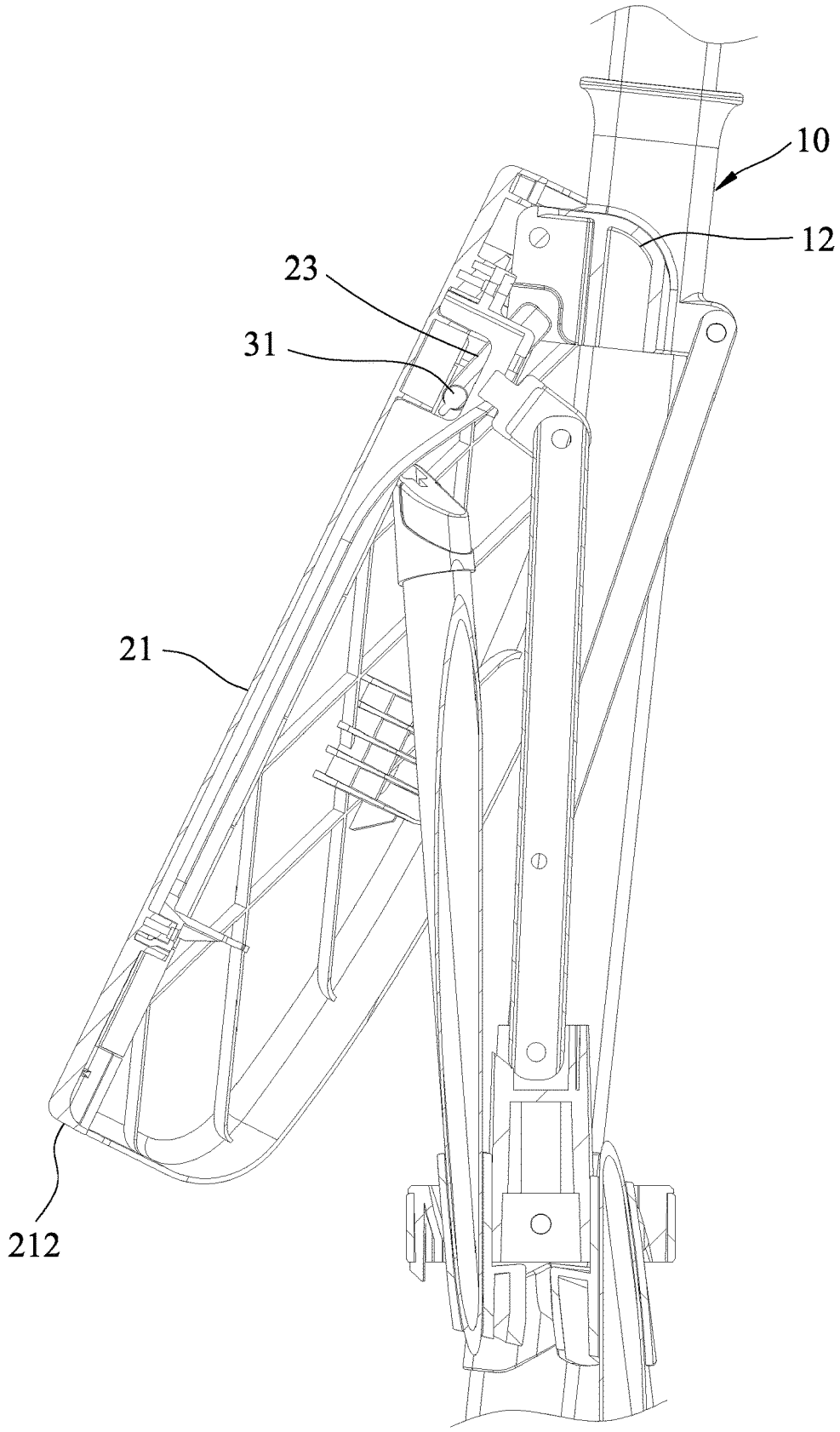
FIG. 10 is a fragmentary, enlarged sectional view of the first embodiment in operation.
Figure 12:
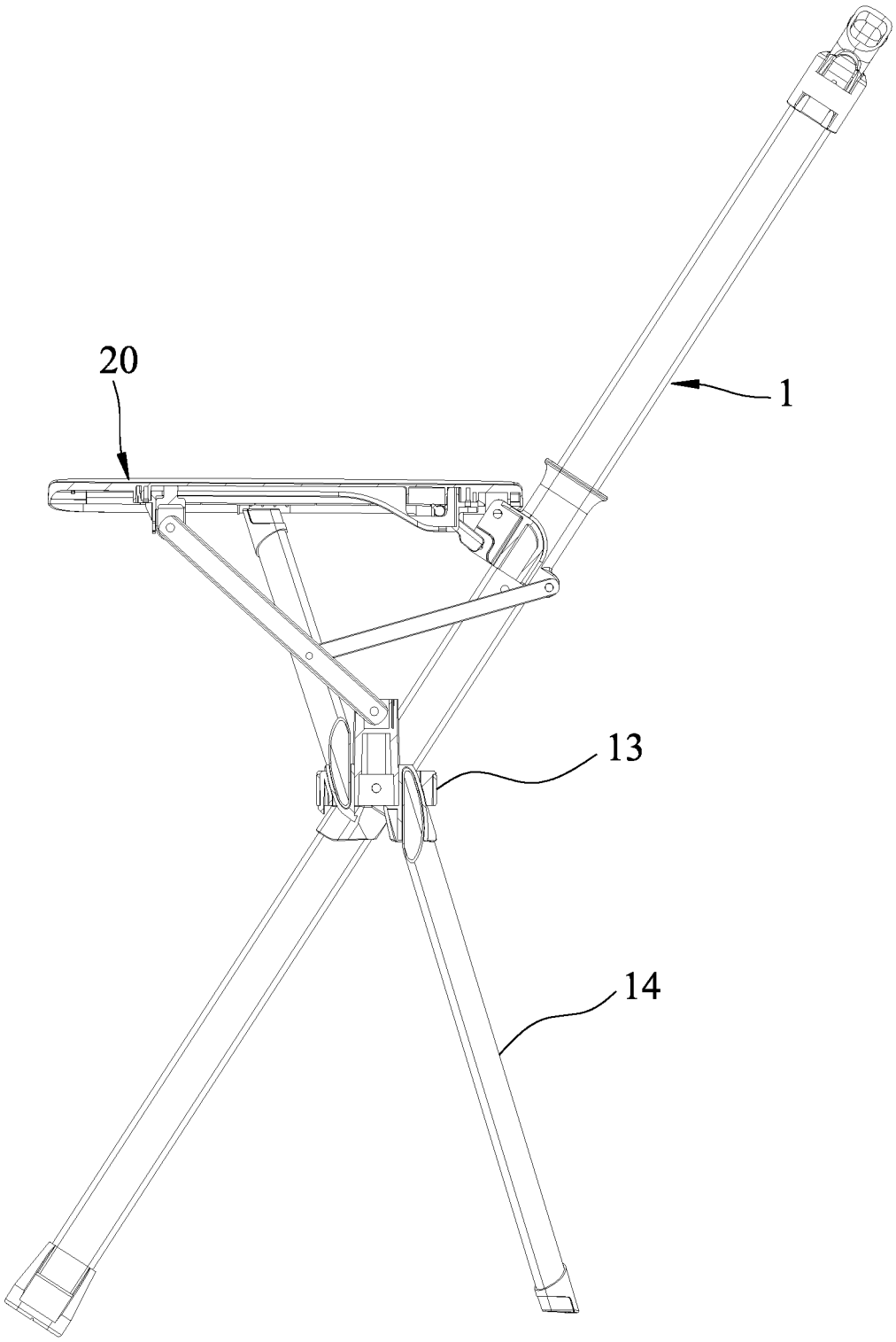
FIG. 12 is a sectional view illustrating the first embodiment in the unfolded state.
Figure 13:
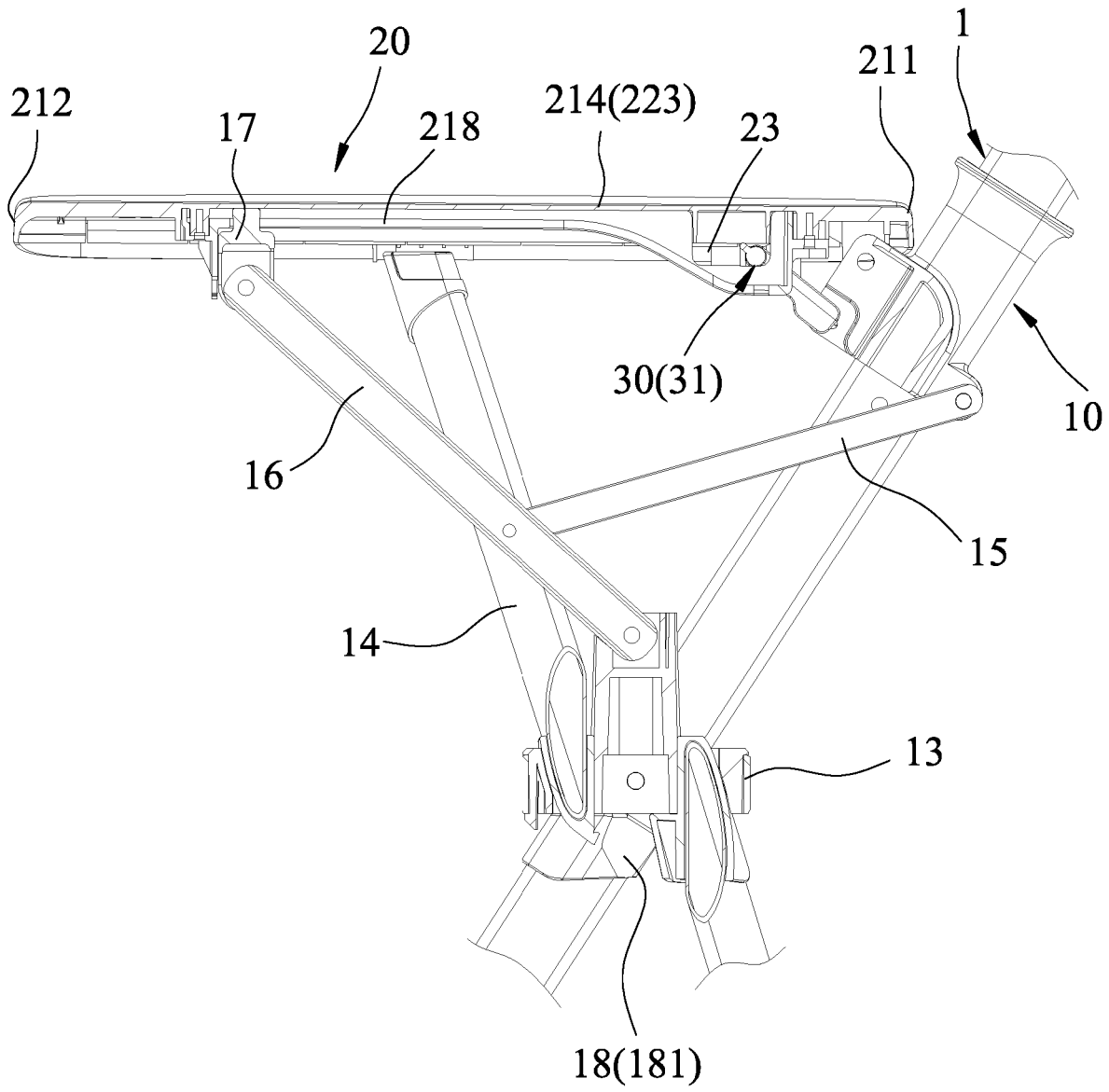
FIG. 13 is a fragmentary, enlarged view of FIG. 12.
Figure 14:
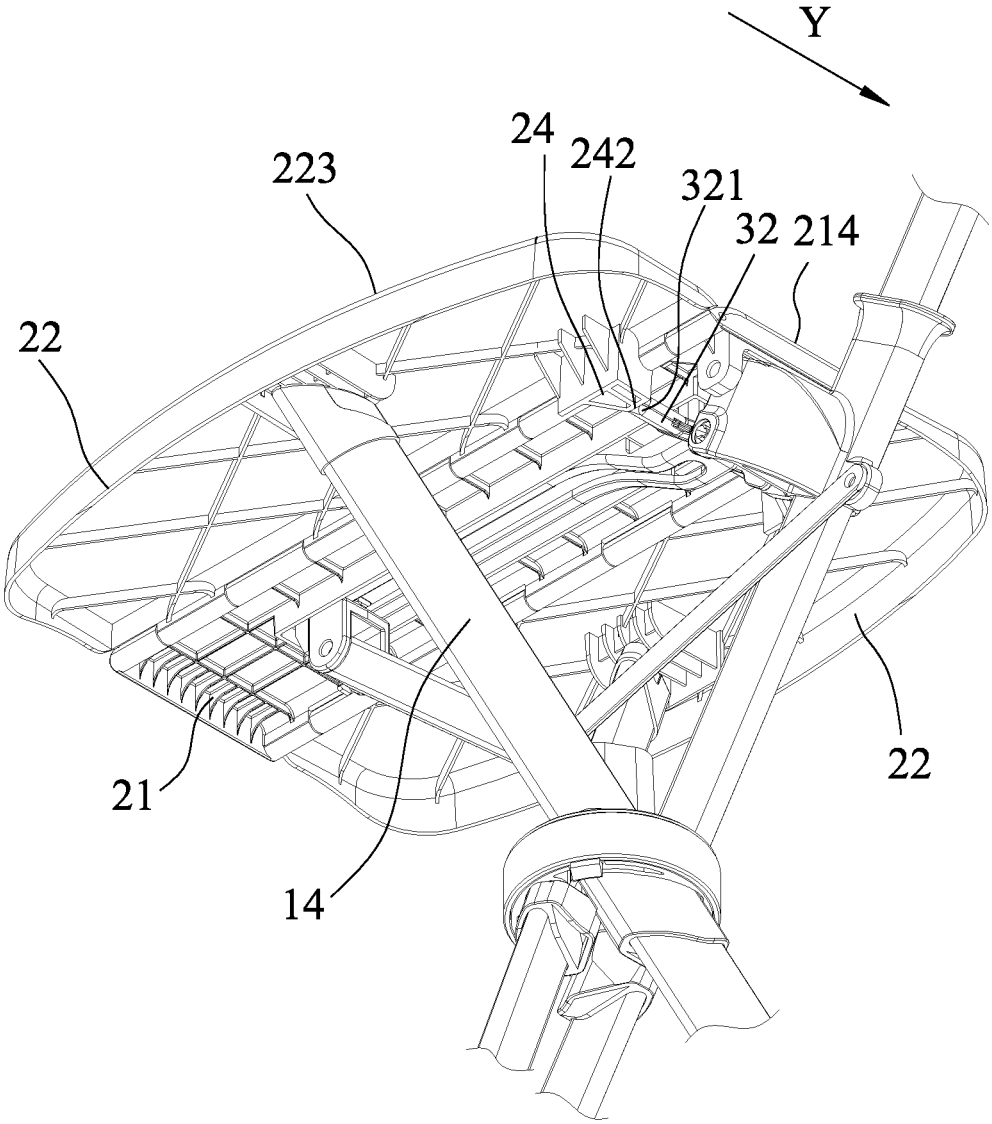
FIG. 14 is a fragmentary, enlarged perspective view of the first embodiment in the unfolded state.

Referring further to FIGS. 8 to 10, in cooperation with FIG. 15, when the second end 212 of the main supporting member 21 is moved away from the pivot seat 13 of the linkage unit 10 by a user (see the arrow in FIG. 8), the main supporting member 21 pivots relative to the linking member 12 of the linkage unit 10. By virtue of the linking member 12 being pivotally connected to the converting unit 30 and by virtue of the bar member 31 of the converting unit 30 being rotatable and movable relative to the guiding section 23 of the main supporting member 21, when the main supporting member 21 pivots relative to the linking member 12, the converting unit 30 rotates and moves relative to the guiding section 23. The converting plates 32 of the converting unit 30 rotate relative to the first main supporting surface 214 and the second main supporting surface 215 of the main supporting member 21 so that the converting part 321 of each of the converting plates 32 moves relative to the push surface 241 of the respective one of the push blocks 24 to push the push block 24 and to urge the auxiliary supporting members 22 to pivot relative to the main supporting member 21. Then, the converting part 321 of each of the converting plates 32 abuts against the abutting surface 242 of the respective one of the push blocks 24 to push the push block 24. At this time, referring further to FIGS. 12 to 14, in cooperation with FIG. 11, the supporting unit 20 is converted into the unfolded state, and the converting plates 32 are located between the push blocks 24 in the second direction (Y). In the first embodiment, the second angle between the first main supporting surface 214 of the main supporting member 21 and the first auxiliary supporting surface 223 of each one of the auxiliary supporting members 22 is 180 degrees. However, in certain embodiments, the second angle may not be 180 degrees.

In FIG. 15, the conversion of the supporting unit 20 is illustrated by a flow diagram. At first, when the supporting unit 20 is in the folded state, the main supporting member 21 is parallel to the slide tube 11 of the linkage unit 10 (i.e., the extending direction of the imaginary axis (L1) is parallel to a direction in which the slide tube 11 extends). Each of the converting plates 32 is parallel to the main supporting member 21, and is located between the main supporting member 21 and the guiding surface 243 of the respective one of the push blocks 24. Then, when the second end 212 of the main supporting member 21 is moved away from the pivot seat 13 of the linkage unit 10 by a user, the bar member 31 of the converting unit 30 moves relative to the guiding section 23 of the main supporting member 21 so that the converting plates 32 are moved toward the first end 211 of the main supporting member 21. At the same time, each of the converting plates 32 is moved toward the inner surface end 245 of the respective one of the push blocks 24 along the push surface 241 of the push block 24 after contacting the outer surface end 244 of the respective one of the push blocks 24. The bar member 31 also rotates relative to the guiding section 23 of the main supporting member 21 so that the converting plates 32 are rotated relative to the first main supporting surface 214 and the second main supporting surface 215 of the main supporting member 21 to respectively push the push blocks 24. By virtue of the first distance (h1) of each of the push blocks 24 being greater than the second distance (h2) of the push block 24, and by virtue of the push surface 241 of each of the push blocks 24 being oblique to the plane that is perpendicular to the imaginary axis (L1) of the main supporting member 21, when the converting plates 32 are moved toward the inner surface ends 245 along the push surfaces 241 of the push blocks 24, the auxiliary supporting members 22 are urged to pivot relative to the main supporting member 21. That is to say, the converting plates 32 are constantly pushing the push blocks 24 when moved toward the first end 211 of the main supporting member 21. In the end, when the supporting unit 20 is converted into the unfolded state, the converting part 321 of each of the converting plates 32 abuts against the abutting surface 242 of the respective one of the push blocks 24 to push the push block 24 so that the auxiliary supporting members 22 are prevented from pivoting relative to the main supporting member 21 (i.e., the supporting unit 20 is kept in the unfolded state). Therefore, the supporting unit 20 is prevented from converting into the folded state, unless a/the user initiates the conversion.

Referring back to FIGS. 6, 10 and 13 again, during the conversion of the supporting unit 20 from the folded state to the unfolded state, the rail connecting member 17 of the linkage unit 10 is moved from the first end 211 toward the second end 212 of the main supporting member 21 along the guiding rail groove 218 of the main supporting member 21. The movement of the rail connecting member 17 drives movements of the first linking rod 15, the second linking rod 16 and the positioning member 1. Specifically, the first linking rod 15 pivots relative to the slide tube 11 and the second linking rod 16. The second linking rod 16 pivots relative to the pivot seat 13 and the rail connecting member 17. The positioning member 1 rotates relative to the pivot seat 13. When the positioning member 1 rotates, the push protrusion 18 of the positioning member 1 pushes the one of the push surfaces 181 of one of the support rods 14 that the push protrusion 18 of the positioning member 1 faces. The movement of the positioning member 1 drives the movements of the support rods 14 so that each of the support rods 14 rotates relative to the pivot seat 13. Therefore, top ends of the positioning member 1 and the support rods 14 are moved away from each other, and bottom ends of the positioning member 1 and the support rods 14 are moved away from each other. In addition, the top ends of the support rods 14 are respectively located under the auxiliary supporting members 22 so as to respectively support the auxiliary supporting members 22 (i.e., each of the support rods 14 abuts against one side of the respective one of the auxiliary supporting members 22 opposite to the first auxiliary supporting surface 223 of the auxiliary supporting member 22). Consequently, when the supporting unit 20 is in the unfolded state, the auxiliary supporting members 22 are prevented from pivoting relative to the main supporting member 21.

When the foldable supporting device is required to be converted from the unfolded state into the folded state, a user can pull the slide tube 11 of the linkage unit 10 upwardly so that the slide tube 11 slides along the positioning member 1 toward the top end of the positioning member 1. As the slide tube 11 slides toward the top end of the positioning member 1, the rail connecting member 17 of the linkage unit 10 is moved from the second end 212 toward the first end 211 of the main supporting member 21 along the guiding rail groove 218 of the main supporting member 21 so that the second end 212 of the main supporting member 21 is moved toward the pivot seat 13 of the linkage unit 10. Consequently, the foldable supporting device is converted into the folded state.

In summary, by virtue of the connections among the components, the supporting unit 20 is able to be converted from the folded state into the unfolded state by simply moving the second end 212 of the main supporting member 21 away from the pivot seat 13 of the linkage unit 10, and is able to be converted from the unfolded state into the folded state by simply pulling the slide tube 11 of the linkage unit 10 upwardly, and the positioning member 1 and the support rods 14 are able to rotate according to the conversion of the supporting unit 20.

Referring to FIG. 3 again, in the first embodiment, in order to connect the converting unit 30 to the linking member 12 of the linkage unit 10, the hole-connecting parts 34 of the converting unit 30 have to be arranged between the pivot holes 121 of the linking member 12 in a manner that the auxiliary protrusion 342 of the hole-connecting parts 34 respectively correspond in position to the auxiliary hole portions 124 of the pivot holes 121 so that the main circular rod portion 341 of the hole-connecting parts 34 are able to respectively extend through the main circular hole portions 123 of the pivot holes 121 when the auxiliary protrusion 342 respectively pass through the auxiliary hole portions 124. Then, the hole-connecting parts 34 of the pivot plates 33 rotate relative to the pivot holes 121 so that the auxiliary protrusion 342 of each of the hole-connecting parts 34 is separated from the auxiliary hole portion 124 of the respective one of the pivot holes 121. Therefore, the hole-connecting parts 34 of the pivot plates 33 will not slide out of the pivot holes 121 during the conversion of the supporting unit 20.

Referring further to FIGS. 16 to 20, a second embodiment of the foldable supporting device according to the disclosure is similar to the first embodiment and includes different configurations of the linkage unit 10', the supporting unit 20' and the converting unit 30'. In the second embodiment, the guiding section 23' of the main supporting member 21' extends toward the first main supporting surface 214' of the main supporting member 21' in a direction from the first end 211' to the second end 212' of the main supporting member 21'. That is to say, the guiding section 23' of the main supporting member 21' is oblique to the extending direction of the imaginary axis (L1) of the supporting unit 20'. The converting unit 30' includes the bar member 31' and the pair of the pivoting plates 33'. The bar member 31' extends through the guiding section 23' of the main supporting member 21', and is rotatable and movable relative to the guiding section 23'. The pivoting plates 33' are connected to the bar member 31', and are pivotally connected to the linkage unit 10' by a rivet. Furthermore, the bar member 31' is configured to be rod-shaped and has two opposite ends in the direction perpendicular to the extending direction of the imaginary axis (L1). Each of the opposite ends of the bar member 31' is disposed with a respective one of the converting parts 321'.

By virtue of the bar member 31' of the converting unit 30' being rotatable and movable relative to the guiding section 23' of the main supporting member 21' that is oblique to the extending direction of the imaginary axis (L1) of the supporting unit 20', when a user moves the second end 212' of the main supporting member 21' away from the pivot seat 13' of the linkage unit 10' or pulls the slide tube 11 of the linkage unit 10' to urge the main supporting member 21' to pivot relative to the linkage member 12' of the linkage unit 10', the converting parts 321' respectively move along the push surfaces 241' of the push blocks 24' so that the supporting unit 20' is convertible between the folded state and the unfolded state. There will be no further description for the movement between each of the converting parts 321' and the respective one of the push surfaces 241' since it is similar to that in the first embodiment.

Thus, the second embodiment has the same functionality and achieves the same results as the first embodiment.

Figure 21:
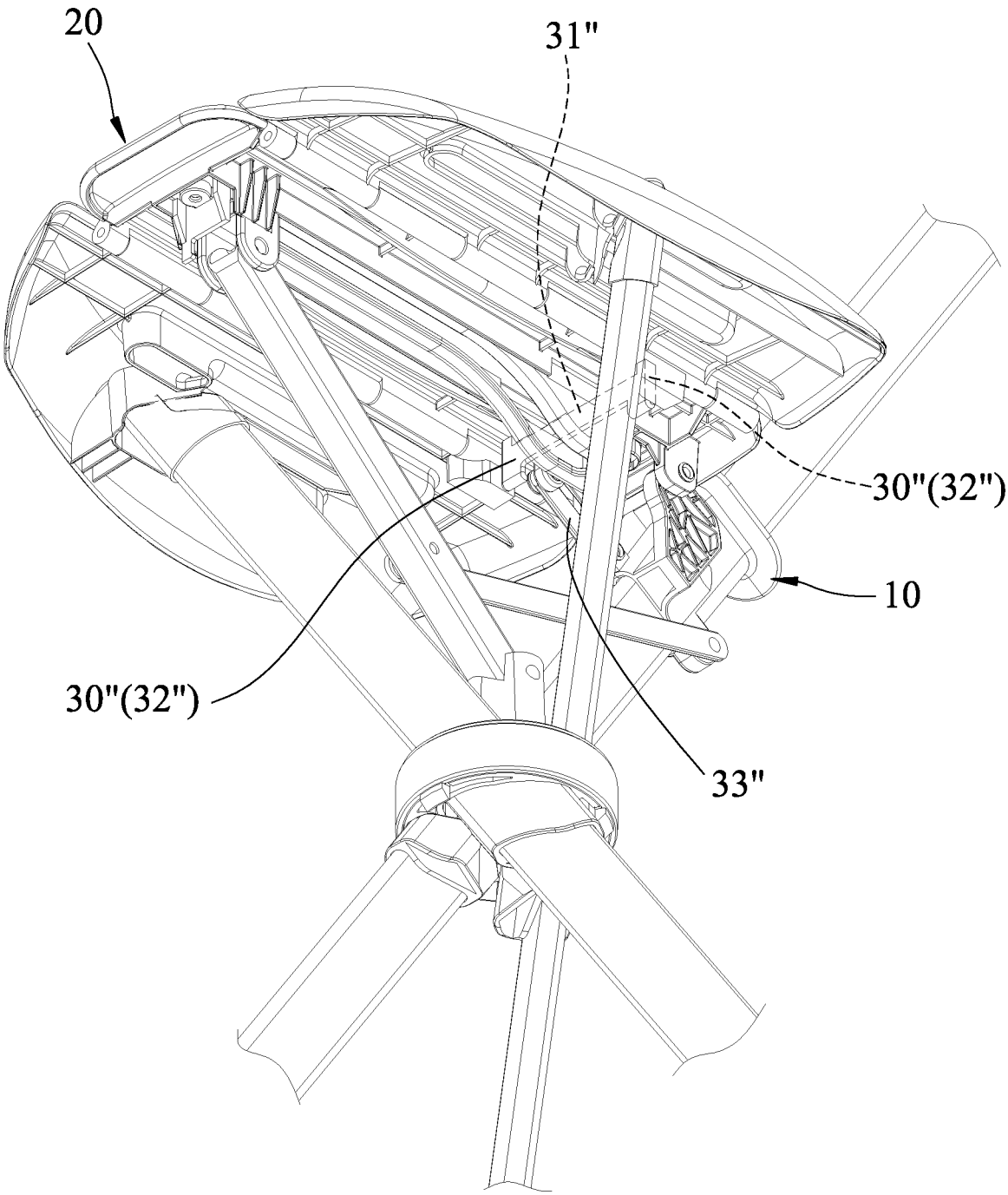
FIG. 21 is a fragmentary perspective view illustrating a third embodiment of the foldable supporting device.

Referring further to FIG. 21, a third embodiment of the foldable supporting device according to the disclosure is similar to the first embodiment and includes different configurations of the linkage unit 10, the supporting unit 20 and the converting unit 30". In the third embodiment, the converting unit 30" includes the bar member 31", the pair of the converting plates 32" and a plate-connecting rod 33". The bar member 31" is configured to be rod-shaped. The converting plates 32" are connected to the bar member 31". The plate-connecting rod 33" pivotally interconnecting one of the converting plates 32" and the linkage unit 10. The third embodiment has the same functionality and achieves the same results as the first and the second embodiments.

Figure 22:
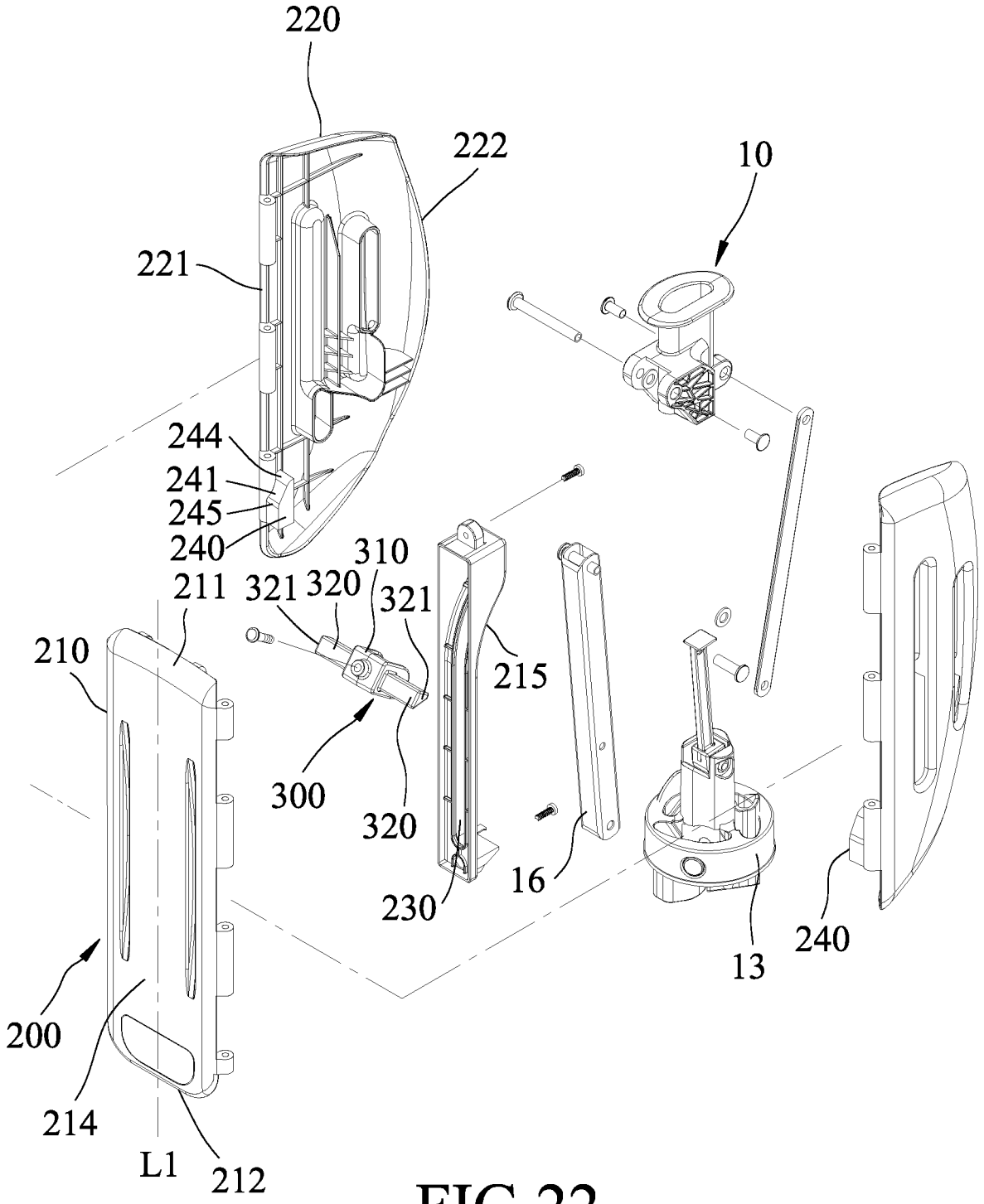
FIG. 22 is a fragmentary, exploded perspective view illustrating a fourth embodiment of the foldable supporting device.
Figure 23:
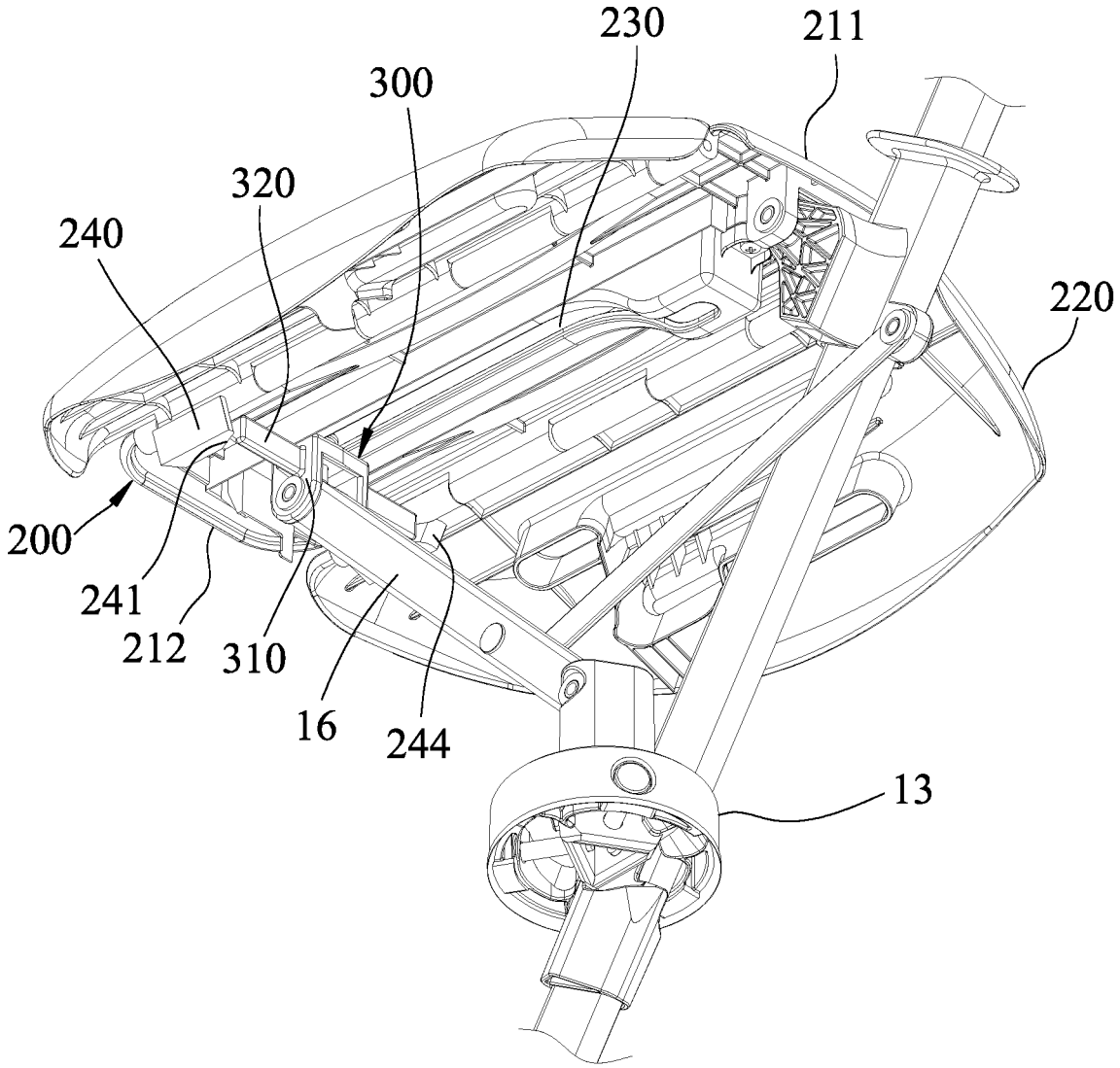
FIG. 23 is a fragmentary perspective view illustrating the fourth embodiment in an unfolded state.

Referring further to FIGS. 22 and 23, a fourth embodiment of the foldable supporting device according to the disclosure includes different configurations of the linkage unit 10, the supporting unit 200 and the converting unit 300. In the fourth embodiment, the push block 240 of each of the auxiliary supporting members 220 is adjacent to the second end 212 of the main supporting member 210. The push surface 241 of the push block 240 of each of the auxiliary supporting members 220 extends toward the second end 212 of the main supporting member 210 when extending from the outer surface end 244 to the inner surface end 245 of the push block 240. The guiding section 230 of the supporting unit 200 is located between the first main supporting surface 214 and the second main supporting surface 215 of the main supporting member 210. Furthermore, in the fourth embodiment, a portion of the guiding rail groove 218 (not shown in FIGS. 22 and 23) in the first embodiment serves as the guiding section 230. The guiding section 230 extends in the extending direction of the imaginary axis (L1). In the fourth embodiment, a portion of the rail connecting member 17 (not shown in FIGS. 22 and 23) of the linkage unit 10 in the first embodiment serves as the bar member 310 of the converting unit 300. The bar member 310 is configured to be a protrusion that is movable along the guiding section 230. The second linking rod 16 of the linkage unit 10 is pivotally connected to the pivot seat 13 of the linkage unit 10 and the bar member 310. The converting plates 320 of the converting unit 300 and the bar member 310 are integrally formed. Each of the converting plates 320 has the converting part 321 that corresponds in position to the push surface 241 of the push block 240 of the respective one of the auxiliary supporting members 220.

The fourth embodiment has same the functionality and achieves the same results as the aforesaid embodiments.

Figure 24:
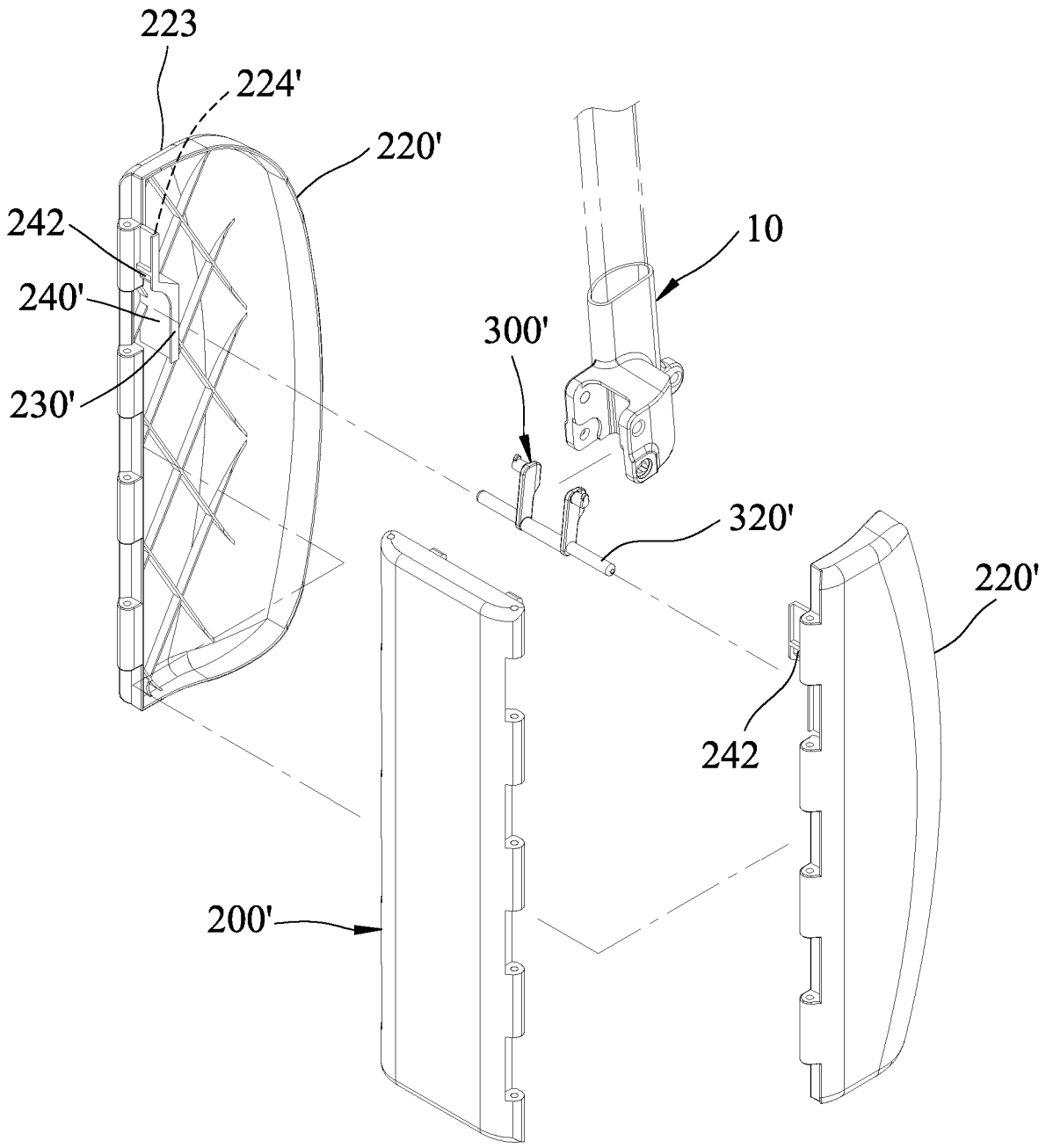
FIG. 24 is a fragmentary, exploded perspective view illustrating a fifth embodiment of the foldable supporting device.
Figure 25:
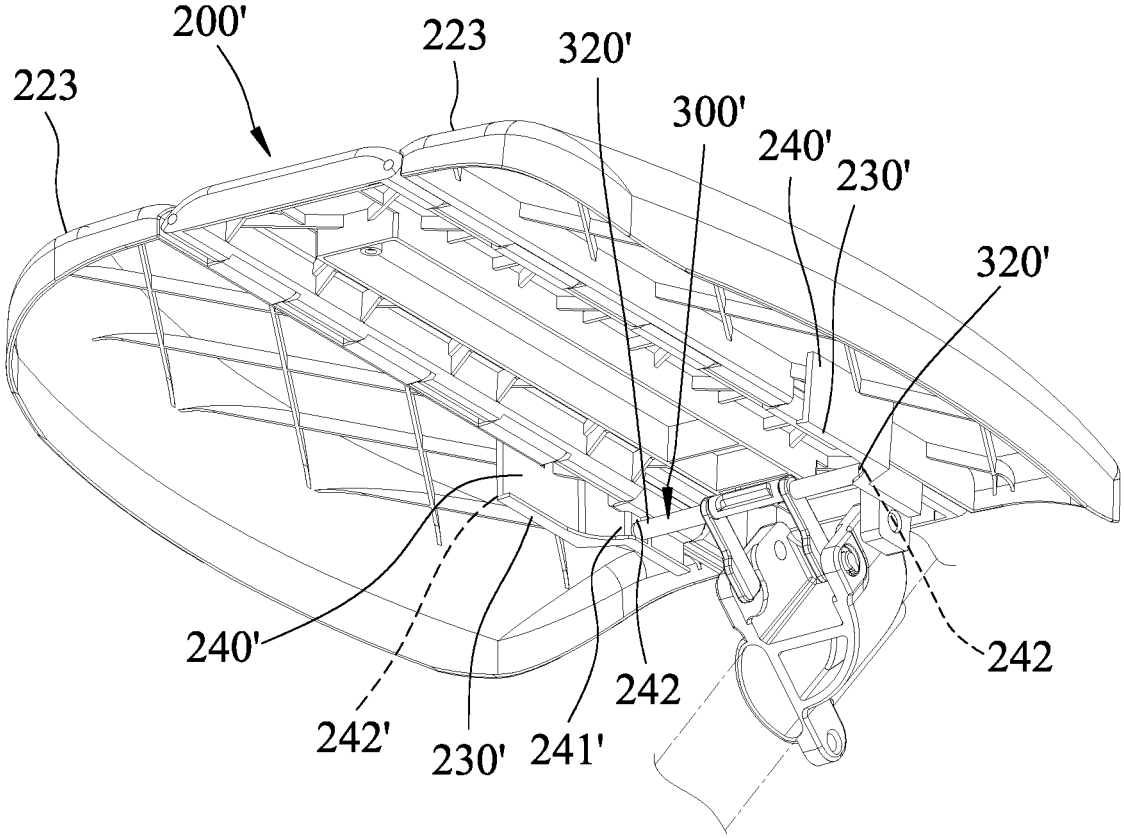
FIG. 25 is a fragmentary perspective view illustrating the fifth embodiment in an unfolded state.

Referring further to FIGS. 24 and 25, a fifth embodiment of the foldable supporting device according to the disclosure includes the linkage unit 10 and different configurations of the supporting unit 200' and the converting unit 300'. In the fifth embodiment, each of the auxiliary supporting members 220' has the guiding section 230'. Specifically, each of the guiding sections 230' of the auxiliary supporting members 220' is disposed on the second auxiliary supporting surface 224' of the push block 240' of the auxiliary supporting member 220', protrudes perpendicularly away from the push surface 241' and the abutting surface 242 of the push block 240', and is parallel to the first auxiliary supporting surface 223 of the auxiliary supporting member 220'. During the conversion of the supporting unit 200' between the folded state and the unfolded state, an end of each of the converting plates 320' opposite to another one of the converting plates 320' is movable along the guiding section 230' of a respective one of the auxiliary supporting members 220'.

In summary, by virtue of the connections among the components, the supporting unit 20 of the foldable supporting device is able to be converted between the folded state and the unfolded state through relatively simple operations. Consequently, the purpose of the disclosure is certainly fulfilled.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A foldable supporting device adapted to be connected to a positioning member, said foldable supporting device comprising:

a supporting unit including
- a main supporting member that is adapted to be connected to the positioning member and that has a first main supporting surface, and
- at least one auxiliary supporting member that is pivotally connected to said main supporting member and that has
- an inner edge adjacent to said main supporting member,
- an outer edge opposite to said inner edge,
- a first auxiliary supporting surface extending from said inner edge to said outer edge,
- a second auxiliary supporting surface opposite to said first auxiliary supporting surface, and
- a push block having
  - a push surface that extends from said second auxiliary supporting surface and that has
    - an inner surface end and an outer surface end respectively proximate to and distal from said inner edge, one of said main supporting member and said at least one auxiliary supporting member having a guiding section that corresponds in position to said push block;

a linkage unit connected to said main supporting member of said supporting unit; and a converting unit corresponding in position to said push block, having at least one converting part, and movably connected to said guiding section of the one of said main supporting member and said at least one auxiliary supporting member such that movement of said linkage unit drives said converting unit to move along said guiding section, and drives said converting part to push said push surface of said push block, so as to convert said supporting unit between a folded state in which said first main supporting surface of said main supporting member and said first auxiliary supporting surface of said at least one auxiliary supporting member cooperatively form a first angle, and an unfolded state in which said first main supporting surface of said main supporting member and said first auxiliary supporting surface of said at least one auxiliary supporting member cooperatively form a second angle that is different from the first angle.

2. The foldable supporting device as claimed in claim 1, wherein said inner edge of said at least one auxiliary supporting member cooperates with said outer surface end of said push block of said at least one auxiliary supporting member to define a first distance therebetween, and cooperates with said inner surface end of said push block to define a second distance therebetween that is smaller than said first distance.

3. The foldable supporting device as claimed in claim 2, wherein said push surface of said push block of said supporting unit is smooth.

4. The foldable supporting device as claimed in claim 2, wherein:

said main supporting member further has a first end and a second end located at two opposite sides of said first main supporting surface, two spaced-apart connecting edges each of which interconnecting said first end and said second end, and a second main supporting surface opposite to said first main supporting surface;

said main supporting member has said guiding section;

said guiding section of said main supporting member is disposed between said connecting edges and is configured to be a groove that is elongated;

said inner edge of said at least one auxiliary supporting member corresponds in position to one of said connecting edges of said main supporting member;

said second auxiliary supporting surface of said at least one auxiliary supporting member is disposed on said push block of said at least one auxiliary supporting member; and said converting unit includes a bar member disposed on one side of said at least one converting part, extending through said guiding section of said main supporting member and rotatable relative to said guiding section of said main supporting member.

5. The foldable supporting device as claimed in claim 4, wherein said push block of said at least one auxiliary supporting member of said supporting unit is adjacent to said first end of said main supporting member; and said push surface of said push block extends toward said first end of said main supporting member when extending from said outer surface end to said inner surface end.

6. The foldable supporting device as claimed in claim 5, wherein said guiding section of said main supporting member is located between said first main supporting surface and said second main supporting surface, is parallel to said first main supporting surface, and is adjacent to said first end of said main supporting member;

said linkage unit is pivotally connected to said first end of said main supporting member;

said bar member of said converting unit is configured to be rod-shaped;

said converting unit further includes at least one converting plate connected to said bar member, and a pivoting plate connected to said at least one converting plate and pivotally connected to said linkage unit; and said at least one converting part and said pivoting plate are respectively disposed on two opposite ends of said converting unit.

7. The foldable supporting device as claimed in claim 4, wherein:

said guiding section of said main supporting member is adjacent to said first end of said main supporting member, extends toward said first main supporting surface of said main supporting member in a direction from said first end to said second end of said main supporting member;

said linkage unit is pivotally connected to said first end of said main supporting member;

said bar member of said converting unit is configured to be rod-shaped;

said converting unit further includes a pivoting plate connected to said bar member and pivotally connected to said linkage unit; and said at least one converting part is disposed on one end of said bar member.

8. The foldable supporting device as claimed in claim 4, wherein said guiding section of said main supporting member is located between said first main supporting surface and said second main supporting surface, is parallel to said first main supporting surface, and is adjacent to said first end of said main supporting member;

said linkage unit is pivotally connected to said first end of said main supporting member;

said bar member of said converting unit is configured to be rod-shaped; and said converting unit further includes at least one converting plate connected to said bar member, and a plate-connecting rod pivotally interconnecting said at least one converting plate and said linkage unit.

9. The foldable supporting device as claimed in claim 4, wherein said push block of said at least one auxiliary supporting member of said supporting unit is adjacent to said second end of said main supporting member; and said push surface of said push block extends toward said second end of said main supporting member when extending from said outer surface end to said inner surface end.

10. The foldable supporting device as claimed in claim 9, wherein said guiding section of said main supporting member is located between said first main supporting surface and said second main supporting surface;

said converting unit further includes a converting plate connected to said bar member and having said at least one converting part; and said at least one converting part of said converting plate corresponds in position to said push surface of said push block of said at least one auxiliary supporting member.

11. The foldable supporting device as claimed in claim 4, wherein:

said main supporting member of said supporting unit has a guiding rail groove;

said at least one auxiliary supporting member includes two auxiliary supporting members respectively and pivotally connected to said connecting edges of said main supporting member;

said linkage unit includes a pivot seat adapted to be pivotally connected to the positioning member, two support rods pivotally connected to said pivot seat, a linking member pivotally connected to said main supporting member and adjacent to said first end of said main supporting member, a slide tube connected to said linking member and adapted to be sleeved on the positioning member, a first linking rod pivotally connected to said slide tube, a second linking rod pivotally connected to said pivot seat and said first linking rod, and a rail connecting member pivotally connected to said second linking rod and movably connected to said guiding rail groove of said main supporting member; and when said supporting unit is in the unfolded state, each of said support rods of said linkage unit abuts against one side of a respective one of said auxiliary supporting members opposite to said first auxiliary supporting surface of said auxiliary supporting member.

12. The foldable supporting device as claimed in claim 4, wherein:

said linkage unit includes a linking member having at least one pivot hole that has a main circular hole portion and an auxiliary hole portion extending radially outwardly from said main circular hole portion;

said converting unit further has at least one hole-connecting part rotatably connected to said at least one pivot hole, and having a main circular rod portion and an auxiliary protrusion that extends radially outwardly from said main rod portion;

said main circular rod portion of said converting unit extends through said at least one pivot hole of said linkage unit; and said auxiliary protrusion of said converting unit is located at one side of said at least one pivot hole and is separated from said auxiliary hole portion of said at least one pivot hole.

13. The foldable supporting device as claimed in claim 1, wherein:

said push block of said at least one auxiliary supporting member further has an abutting surface connected to said inner surface end of said push surface; and said at least one converting part of said converting unit is able to abut against said abutting surface to keep said supporting unit in the unfolded state.

14. The foldable supporting device as claimed in claim 13, wherein:

said at least one auxiliary supporting member has said guiding section; and said guiding section of said main supporting member is disposed on said push block, protrudes perpendicularly away from said push surface and said abutting surface of said push block, and is parallel to said first auxiliary supporting surface of said at least one auxiliary supporting member.

* * * * *